US010276919B2

(12) United States Patent
Diebold et al.

(10) Patent No.: US 10,276,919 B2
(45) Date of Patent: Apr. 30, 2019

(54) TERAHERTZ DEVICE AND TERAHERTZ INTEGRATED CIRCUIT

(71) Applicants: ROHM CO., LTD., Kyoto (JP); OSAKA UNIVERSITY, Osaka (JP)

(72) Inventors: Sebastian Diebold, Osaka (JP); Masayuki Fujita, Osaka (JP); Tadao Nagatsuma, Osaka (JP); Jaeyoung Kim, Kyoto (JP); Toshikazu Mukai, Kyoto (JP); Kazuisao Tsuruda, Kyoto (JP)

(73) Assignees: ROHM CO., LTD., Kyoto (JP); OSAKA UNIVERSITY, Osaka (JP)

( * ) Notice: Subject to any disclaimer, the term of this patent is extended or adjusted under 35 U.S.C. 154(b) by 0 days.

(21) Appl. No.: 15/443,636

(22) Filed: Feb. 27, 2017

(65) Prior Publication Data

US 2017/0250458 A1 Aug. 31, 2017

(30) Foreign Application Priority Data

Feb. 29, 2016 (JP) ..... 2016-036996

(51) Int. Cl.
*H01Q 1/22* (2006.01)
*H01Q 3/26* (2006.01)
(Continued)

(52) U.S. Cl.
CPC ..... *H01Q 1/2283* (2013.01); *H01Q 3/2676* (2013.01); *H01Q 5/335* (2015.01); *H01Q 15/14* (2013.01)

(58) Field of Classification Search
CPC ..... H03B 7/08; H03B 2200/0084
See application file for complete search history.

(56) References Cited

U.S. PATENT DOCUMENTS

2010/0026401 A1* 2/2010 Mukai ..... H03B 7/08 331/107 T

FOREIGN PATENT DOCUMENTS

JP 2007-124250 A 5/2007
JP 2010-057161 A 3/2010
(Continued)

OTHER PUBLICATIONS

"Two element Tapered Slot Antenna Array for Terahertz Resonant Tunneling Diode Oscillators", Int'l Journal of Antennas and Propagation, (2014) p. 1-8 to Li et al.*
(Continued)

*Primary Examiner* — Kenneth J Malkowski
(74) *Attorney, Agent, or Firm* — Rabin & Berdo, P.C.

(57) ABSTRACT

A THz device includes: an antenna electrode capable of transmitting and receiving a THz wave to free space; first transmission lines capable of transmitting the THz wave, the first transmission lines respectively connected to the antenna electrodes; an active element of which a main electrode is connected to each of the first transmission lines; second transmission lines capable of transmitting the THz wave, the second transmission lines connected to the first active device; pad electrodes respectively connected to the second transmission lines; and a low-pass filter with respect to the THz wave, the low-pass filter connected to the pad electrodes, wherein impedance matching of between the antenna electrode and the active element is performed by an impedance conversion of the first transmission lines. The THz device is capable of the high-efficiency matching between the active element and the antenna due to the impedance conversion effect of the transmission line.

13 Claims, 23 Drawing Sheets

(51) Int. Cl.
*H01Q 5/335* (2015.01)
*H01Q 15/14* (2006.01)

(56) References Cited

FOREIGN PATENT DOCUMENTS

| | | | |
|---|---|---|---|
| JP | 2012-084888 | A | 4/2012 |
| JP | 2012-217107 | A | 11/2012 |

OTHER PUBLICATIONS

"Terahertz Wireless Communications Using Resonant Tunneling Diodes as Transmitters and Receivers" (2014), p. 41-46, to Kaku et al.*

Hiroki Sugiyama et al.,"Room Temperature Resonant-tunneling-diode Terahertz Oscillator Based on Precisely Controlled Semiconductor Epitaxial Growth Technology", NTT Technical Review, vol. 9 No. 10, 2011.

Naoyuki Orihashi et al., "Experimental and Theoretical Characteristics of Sub-Terahertz and Terahertz Oscillations of Resonant Tunneling Diodes Integrated with Slot Antennas", Japanese Journal of Applied Physics, vol. 44, No. 11, Nov. 2005, pp. 7809-7815.

Kenta Urayama et al., "Sub-Terahertz Resonant Tunneling Diode Oscillators Integrated with Tapered Slot Antennas for Horizontal Radiation", Applied Physics Express, 2, Apr. 10, 2009, pp. 044501-1-044501-3.

Shunsuke Nakai et al., "Broadband Operation in Resonant Tunneling Diodes Integrated with Dipole Antenna", Institute of Electronics, Information and Communication Engineers (IEICE), Proceedings of the IEICE General Conference, C-14-15, Mar. 10, 2015.

* cited by examiner

TERAHERTZ DEVICE AND TERAHERTZ INTEGRATED CIRCUIT

CROSS REFERENCE TO RELATED APPLICATIONS

This application is based upon and claims the benefit of priority from prior Japanese Patent Application No. P2016-036996 filed on Feb. 29, 2016, the entire contents of which are incorporated herein by reference.

FIELD

Embodiments described herein relate to a terahertz (THz) device and a THz integrated circuit.

BACKGROUND

In recent years, since miniaturization of electron devices, such as a transistor, progresses, and the size thereof has nano size, a new phenomenon called a quantum effect has been observed. Then, the development which aimed at achieving of ultra high-speed devices or new functional devices is advanced using such a quantum effect. In such environment, trials to perform large capacity communication, information processing, or imaging or measurement, etc. has been performed using the frequency region which is in particular called a THz band and of which frequency is from 0.1 THz ($10^{11}$ Hz) to 10 THz. This frequency domain is undeveloped frequency region between light and electromagnetic waves, and if the device which operates with this frequency band is achieved, being used for many uses, such as measurement in various fields, such as physical characteristics, astronomy, living things, etc. the imaging, the large capacity communication and the information processing mentioned above, is expected.

As devices for oscillating high frequency electromagnetic waves of a THz frequency band, there have been known devices having a structure in which a Resonant Tunneling Diode (RTD) and a minute slot antenna is integrated. Moreover, there have been disclosed devices having a Metal Insulator Metal (MIM) structure in which metals and an insulator are layered and the insulator is inserted between the electrode metals in order to short-circuit in terms of high frequencies, at both ends of a slot antenna.

As the THz signal modulation and demodulation in RTD devices in conventional technologies, there have been already disclosed a direct modulation method and a direct detection method of the RTD.

Real-time error free wireless communications have been reported as transceivers 2.5 Gbps and as receivers of 17 Gbps until now, to realize miniaturization and integration of THz-wave devices/systems, as RTD which can transmit and receive the THz waves.

As an antenna of conventional THz devices, there have been disclosed an example of using a slot antenna, and an example of using a dipole antenna. In the example of using the slot antenna, the slot antenna and a resonator unit are integrated therewith. On the other hand, in the example of using the dipole antenna, a resonator unit is connected to the dipole antenna.

SUMMARY

The embodiments provide a THz device capable of high-efficiency matching between an active element and an antenna due to an impedance conversion effect of a transmission line.

The embodiments provides a THz integrated circuit of which transmitting and receiving efficiency in a phase modulation, a synchronous detection, and a modulation/demodulation of a THz signal can be improved by applying such a THz device and by mixing a THz wave with a data signal of a local oscillator.

According to one aspect of the embodiments, there is provided a terahertz device comprising: an antenna capable of transmitting and receiving a THz wave to free space; first transmission lines capable of transmitting the THz wave, the first transmission lines connected to the antenna; an active element of which a main electrode is connected to each of the first transmission lines; second transmission lines capable of transmitting the THz wave, the second transmission lines connected to the active device; pad electrodes respectively connected to the second transmission lines; and a low-pass filter (LPF) with respect to the THz wave, the low-pass filter connected to the pad electrodes, wherein impedance matching of between the antenna and the active element is performed by an impedance conversion of the first transmission lines.

According to another aspect of the embodiments, there is provided a terahertz device comprising: an antenna unit comprising an antenna capable of transmitting and receiving a THz wave to free space, and a first transmission line connected to the antenna; an active element capable of transmitting and receiving the THz wave, the active element connected to the first transmission line; and a resonator unit comprising a second transmission line for supplying an electric power to the active element, the second transmission line connected to the active element, and a low-pass filter with respect to the THz wave, the low-pass filter connected to the second transmission line, wherein impedance matching of between the antenna and the active element is performed by an impedance conversion of the first transmission line.

According to still another aspect of the embodiments, there is provided a terahertz integrated circuit comprising: antenna electrodes capable of transmitting and receiving a THz wave to free space; first transmission lines capable of transmitting the THz wave, the first transmission lines respectively connected to the antenna electrodes; third transmission lines capable of transmitting the THz wave, the third transmission lines respectively connected to the first transmission lines; second pad electrodes respectively connected to the third transmission lines; a second low-pass filter with respect to the THz wave, the second low-pass filter connected to the pad electrodes; a second active device of which a main electrode is connected to the third transmission lines; fourth transmission lines capable of transmitting the THz wave, the fourth transmission lines connected to the second active device; a first active device of which a main electrode is connected to the fourth transmission lines, the first active device disposed on the fourth transmission lines so as to be isolated from the second active device; second transmission lines capable of transmitting the THz wave, the second transmission lines connected to the first active device; first pad electrodes respectively connected to the second transmission lines; and a first low-pass filter with respect to the THz wave, the first low-pass filter connected to the first pad electrodes, wherein impedance matching of between the antenna electrodes and the first active element is performed by an impedance conversion of the first transmission lines.

According to yet another aspect of the embodiments, there is provided a terahertz integrated circuit comprising: an antenna unit comprising an antenna capable of transmitting and receiving a THz wave to free space, and a first transmission line connected to the antenna; a mixer unit connected to the antenna unit; a first active device capable of transmitting and receiving the THz wave, the first active device connected to the first transmission line via the mixer unit; and a resonator unit comprising a second transmission line for supplying an electric power to the first active element, the second transmission line connected to the first active element, and a first low-pass filter with respect to the THz wave, the first low-pass filter connected to the second transmission line, wherein impedance matching of between the antenna and the first active element is performed by an impedance conversion of the first transmission line.

According to further aspect of the embodiments, there is provided a terahertz integrated circuit comprising: an antenna unit comprising an antenna capable of transmitting and receiving a THz wave to free space, and a first transmission line connected to the antenna; a first mixer unit and a second mixer unit connected to the antenna unit; a first active device capable of transmitting and receiving the THz wave, the first active device connected to the first transmission line via the first mixer unit; and a 90° phase converter disposed between the second mixer unit and the first active device; and a resonator unit comprising a second transmission line for supplying an electric power to the first active element, the second transmission line connected to the first active element, and a first low-pass filter with respect to the THz wave, the first low-pass filter connected to the second transmission line, wherein impedance matching of between the antenna and the first active element is performed by an impedance conversion of the first transmission line.

According to still further aspect of the embodiments, there is provided a terahertz integrated circuit comprising the above-mentioned terahertz device.

According to the embodiments, there can be provided the THz device capable of the high-efficiency matching between the active element and the antenna due to the impedance conversion effect of the transmission line.

According to the embodiments, there can be provided the THz integrated circuit of which the transmitting and receiving efficiency in the phase modulation, the synchronous detection, and the modulation/demodulation of the THz signal can be improved by applying such a THz device and by mixing the THz wave with the data signal of the local oscillator.

DESCRIPTION OF EMBODIMENTS

Figure 1A:
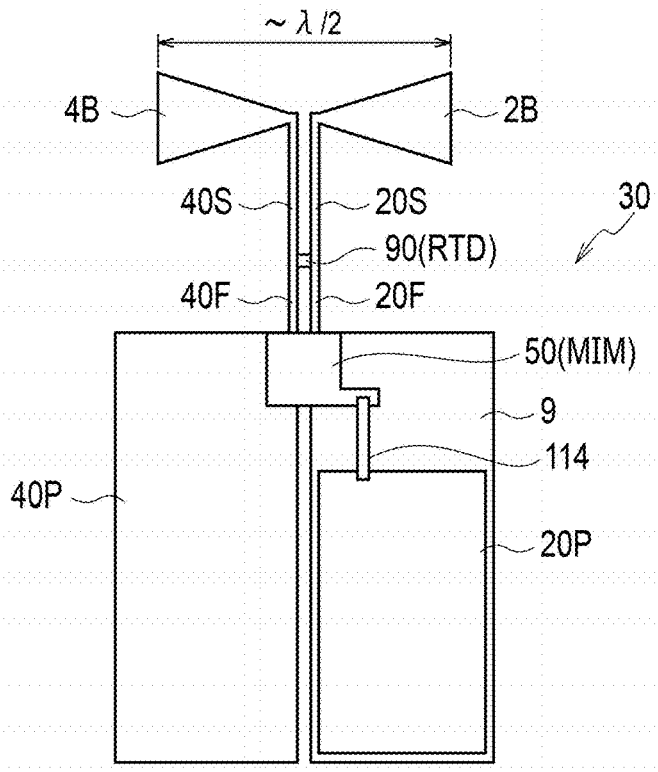
FIG. 1A is a schematic planar pattern configuration diagram of a THz device according to the first embodiment (an example of a bow tie antenna).

Next, certain embodiments will now be described with reference to drawings. In the following drawings, same blocks or elements are designated by same reference characters to eliminate redundancy and for simplicity. However, it should be known about that the drawings are schematic and are differ from an actual thing. Of course, the part from which the relation and ratio of a mutual size differ also in mutually drawings is included.

Moreover, the embodiments shown hereinafter exemplify the apparatus and method for materializing the technical idea; and the embodiments does not specify the arrangement, etc. of each component part as the following. The embodiments may be changed without departing from the spirit or scope of claims.

First Embodiment

Figure 1B:
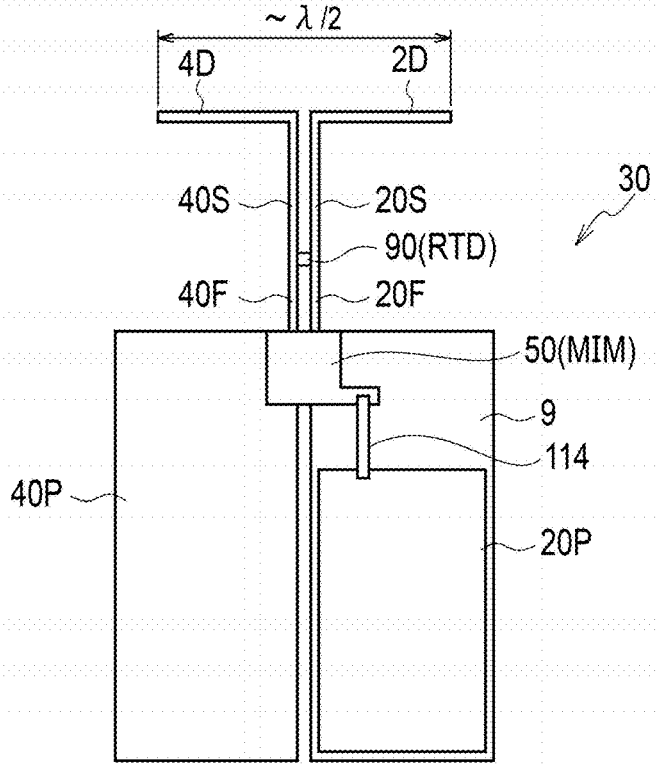
FIG. 1B is a schematic planar pattern configuration diagram of the THz device according to the first embodiment (an example of a dipole antenna).

FIG. 1A shows an example of a bow tie antenna, as a schematic planar pattern configuration of a THz device 30 according to the first embodiment, and FIG. 1B shows an example of a dipole antenna.

As shown in FIG. 1A or 1B, the THz device 30 according to the first embodiment includes: antenna electrodes 4B, 2B capable of transmitting and receiving a THz wave to/from free space; first transmission lines 40S, 20S capable of transmitting the THz wave, the first transmission lines 40S, 20S respectively connected to the antenna electrodes 4B, 2B; an active element 90 of which a main electrode is connected to each of the first transmission lines 40S, 20S; second transmission lines 40F, 20F capable of transmitting the THz wave, the second transmission lines 40F, 20F respectively connected to the active element 90; pad electrodes 40P, 20P respectively connected to the second transmission lines 40F, 20F; and a low-pass filter 50 with respect to the THz wave, the low-pass filter 50 connected to the pad electrodes 40P, 20P. In the embodiments, impedance matching of between the antenna electrodes 4B, 2B and the active element 90 can be realized by an impedance conversion of the first transmission lines 40S, 20S. The pad electrodes 20P, 40P can compose an electrode for supplying bias power and data signal.

The low-pass filter 50 may include a Metal-Insulator-Metal (MIM) reflector.

Moreover, a resistance element 114 connected between the pad electrodes 40P, 20P may be provided.

Moreover, the resistance element 114 may include metallic wiring.

The metallic wiring may include Bi, Ni, Ti, or Pt, in the embodiment.

Figure 20:
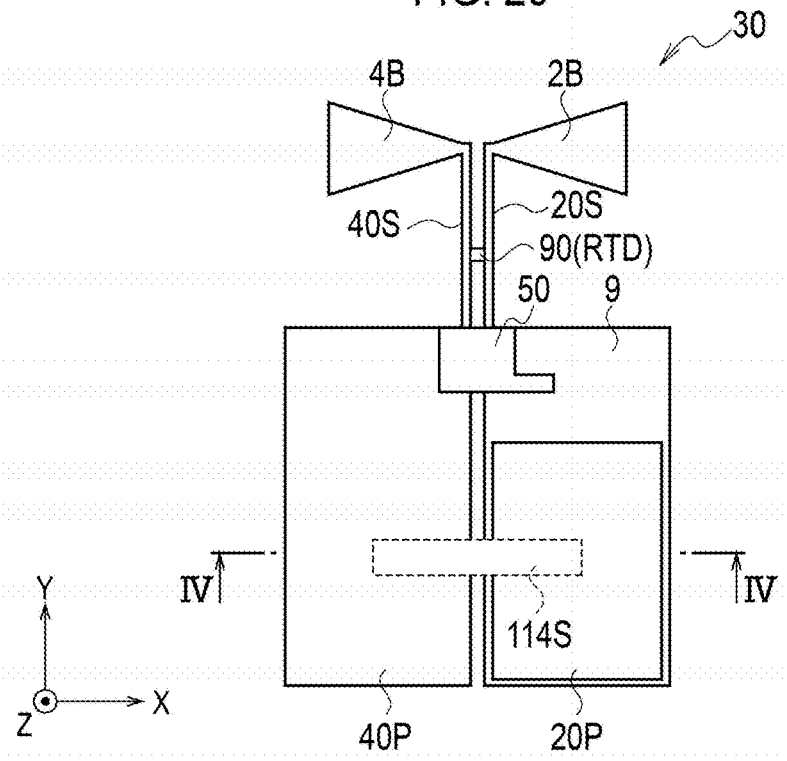
FIG. 20 is a schematic planar pattern configuration diagram of an implementation example of a parallel resistance formed with a semiconductor layer, in the THz device according to the first embodiment.
Figure 21:
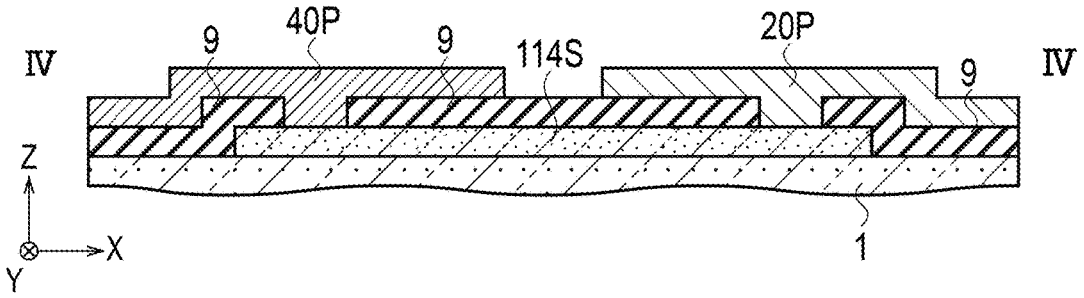
FIG. 21 is a schematic cross-sectional structure diagram taken in the line IV-IV in FIG. 20.

Moreover, the resistance element may include a semiconductor layer, as shown in FIGS. 20 to 21.

As the antenna, although examples of the bow tie antenna and the dipole antenna are illustrated, other antennas, such as a slot antenna, a patch antenna, a ring antenna, or a Yagi-Uda antenna, may be provided.

The THz device 30 according to the first embodiment can be formed on a semiconductor substrate 1.

Figure 19:
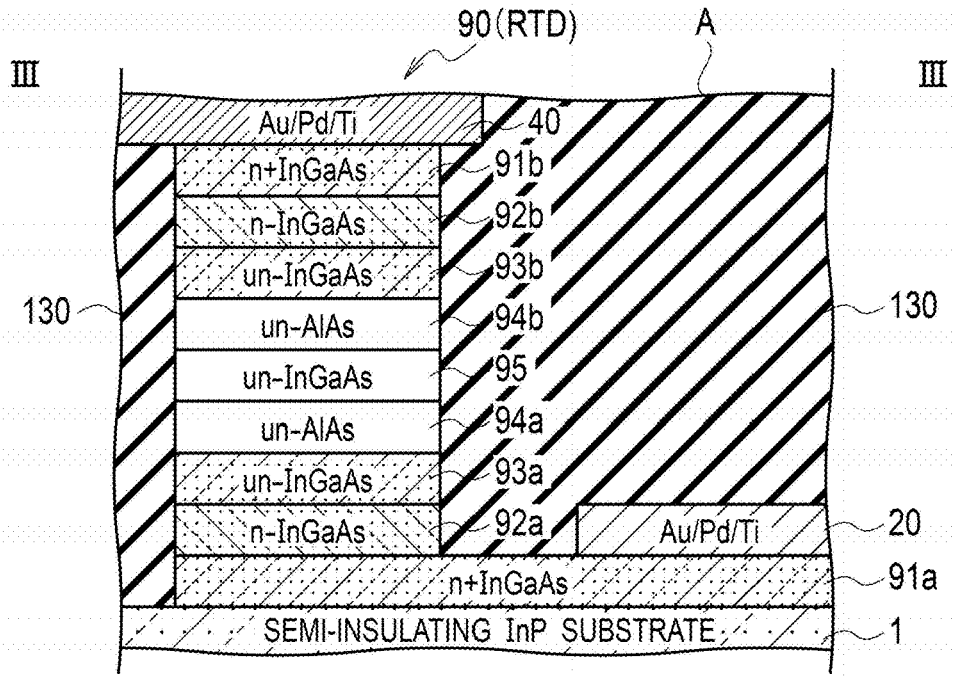
FIG. 19 is an enlarged schematic cross-sectional structure diagram of the portion A in FIG. 18.

More specifically, as shown in FIG. 19, the THz device 30 according to the first embodiment may include: the semiconductor substrate 1; a first semiconductor layer 91*a* disposed on the semiconductor substrate 1; a second electrode 20 connected to one side of a main electrode of the active element 90 formed so as to be layered on the first semiconductor layer 91*a*, the second electrode 20 connected to the first semiconductor layer 91*a* and disposed on the semiconductor substrate 1; and a first electrode 40 connected to another side of the main electrode of the active element 90, the first electrode 40 disposed on the semiconductor substrate 1 so as to be opposite to the second electrode 20. In the embodiments, the first electrode 40 and the second electrode 20 are connected to the first transmission lines 40S, 20S.

An example of the size of structure is as follows. More specifically, a length of each antenna is approximately ½ wavelength ($\lambda/2$). The lengths of both antennas are fundamentally designed to be the same, or the length of the bow tie antenna is designed to be shorter than that of the dipole antenna. An interval between the antenna electrodes 4B, 2B of the bow tie antenna is substantially equal to an interval of the transmission line. An interval between the antenna electrodes 4D, 2D of the dipole antenna is also substantially equal to the interval of the transmission line. A bow tie edge width of the bow tie antenna has an effective wide width design for broader bandwidths, and is effective to set to equal to or less than ¼ wavelength, for example. Although an edge width connected to the transmission lines 40S, 20S of the bow tie antenna fundamentally may be set to be substantially equal to a width of the transmission lines 40S, 20S, it is effective to adjust the design thereof in the light of power loss. For example, the width of the transmission lines 40S, 20S is effective to be approximately 5 μm to approximately 10 μm, for example.

(Block Configuration)

Figure 2A:
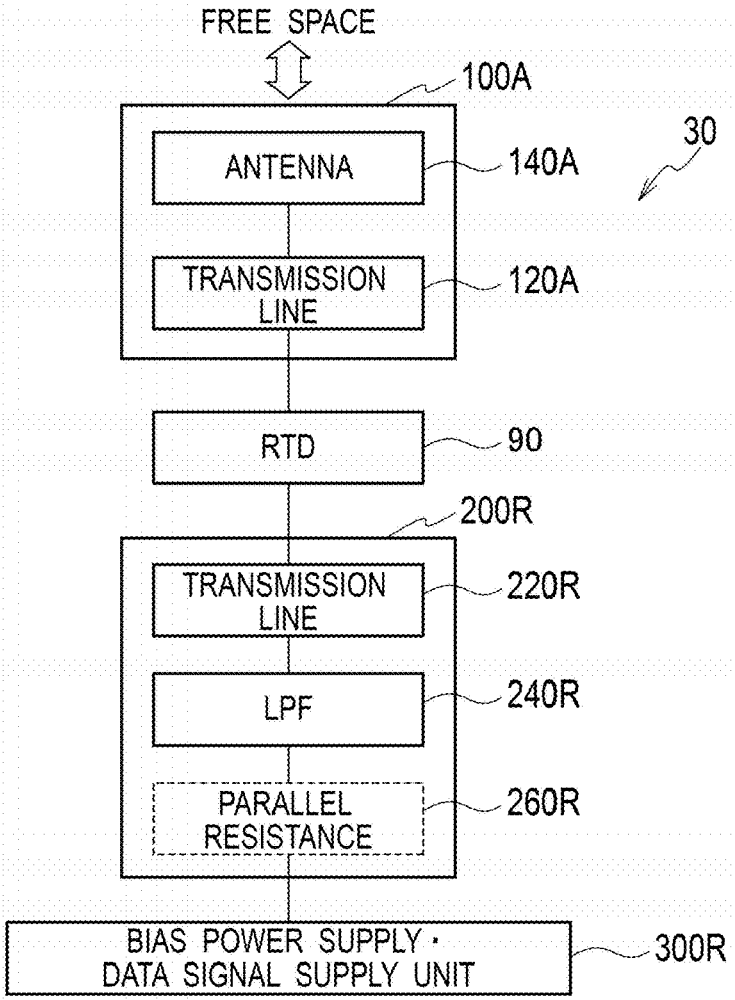
FIG. 2A is a schematic block configuration diagram of the THz device according to the first embodiment.

FIG. 2A shows a schematic block configuration of the THz device 30 according to the first embodiment.

As shown in FIG. 2A, the THz device 30 according to the first embodiment includes: an antenna unit 100A including an antenna 140A capable of transmitting and receiving a THz wave to free space, and a first transmission line 120A connected to the antenna 140A; an active element 90 capable of transmitting and receiving the THz wave, the active element 90 connected to the first transmission line 120A; and a resonator unit 200R including a second transmission line 220R for supplying an electric power to the active element 90, the second transmission line 220R connected to the active element 90, and a low-pass filter 240R with respect to the THz wave, the low-pass filter 240R connected to the second transmission line 220R. In the embodiments, impedance matching of between the antenna 140A and the active element 90 can be realized by an impedance conversion of the first transmission line 120A.

Moreover, as shown in FIG. 2A, the THz device 30 according to the first embodiment may further include bias power supply and data signal supply unit 300R for supplying bias power and a data signal to the active element 90, the bias power supply & data signal supply unit 300R connected to the resonator unit 200R.

According to the THz device 30 according to the first embodiment, a parameter of the resonator unit 200R can be independently adjusted.

According to the THz device 30 according to the first embodiment, since a free layout design can be realized, an improvement of circuit performance and a functional addition can be realized.

In the THz device 30 according to the first embodiment, the parallel resistance 114 give a power loss with respect to low frequencies, and thereby a effect of reducing a parasitic oscillation can be expected.

According to the THz device 30 according to the first embodiment, the high-powered RID oscillator with the oscillation frequency of 300 GHz can be realized by introducing the matching circuit between the RTD and the antenna.

Figure 2B:
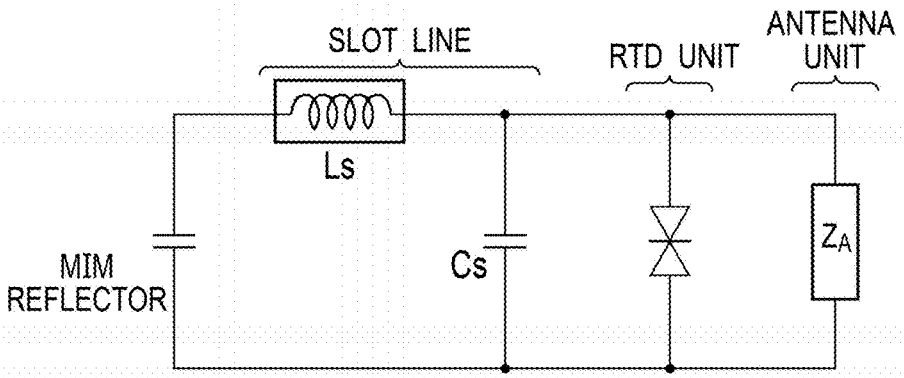
FIG. 2B is a schematic equivalent circuit configuration diagram of the THz device according to the first embodiment.

FIG. 2B shows a schematic equivalent circuit configuration of the THz device 30 according to the first embodiment.

The THz device 30 according to the first embodiment is composed including the MIM reflector 50, the transmission lines (slot line) (40S, 40F), (20S, 20F), the RTD 90, and the antennas (4B and 2B), as shown in FIG. 2B. Moreover, the oscillation frequency is determined with an inductance $L_s$ and capacitance $C_s$ of the slot line, a capacitance of the RTD, and an RLC resonant frequency including the antennas. The impedance $Z_A$ of the antenna unit is expressed with the following equation (1):

$$Z_A=R_A+jX_A \quad (1)$$

where $R_A$ is antenna resistance, j is an imaginary unit, and $X_A$ is an imaginary component of the antenna impedance.

The THz device 30 according to the first embodiment composes a stripline-based RTD integrated circuit. More specifically, the antenna unit 100A and the resonator unit 200R are separated from each other, centering on the RTD 90. The antenna unit 100A includes the antenna unit of having a strip-line structure, and the resonator unit 200R includes the resonator unit having a strip-line structure. The antenna 140A also includes the planar antenna structure having a strip line structure.

The antenna 140A can be composed including a metal planar antenna formed on the semiconductor substrate 1. An input/output of the THz wave with respect to free space can be achieved.

The transmission line 120A is a transmission line for performing an impedance adjustment between the RTD and the antenna, and spatially separates between the antenna and the RTD.

The RTD 90 provides current-voltage characteristics having a negative resistance and nonlinear characteristics for an operation of the oscillator, the mixer, and the detector.

The transmission line 220R has a function of impedance matching and as a resonator unit of the oscillator. The THz wave which propagates through the transmission line 220R is reflected on the LPF 240R, and thereby the transmission line 220R is operated as a resonator.

The LPF 240R has a function of reflecting the THz wave and passing through signals having frequencies lower than a frequency band of the THz wave from a direct current (DC). Consequently, it is possible to supply the DC bias voltage to the RTD, and to exchange data signals. It is also possible to add the parallel resistance 260R which gives a power loss to signals having frequencies lower than a frequency band of the THz wave for the purpose of operation stability.

According to the THz device 30 according to the first embodiment, since the RTD and the flat surface transmission line which are two terminals are utilized, the integrated circuit configuration having super-high frequencies is easily realized.

According to the THz device 30 according to the first embodiment, a combination and arrangement of functional devices, e.g. the oscillator, the mixer, and the detector, are achieved by physically separating between the antenna and the resonator unit.

(Parameters of Resonator Unit and Antenna Unit)

Figure 3:
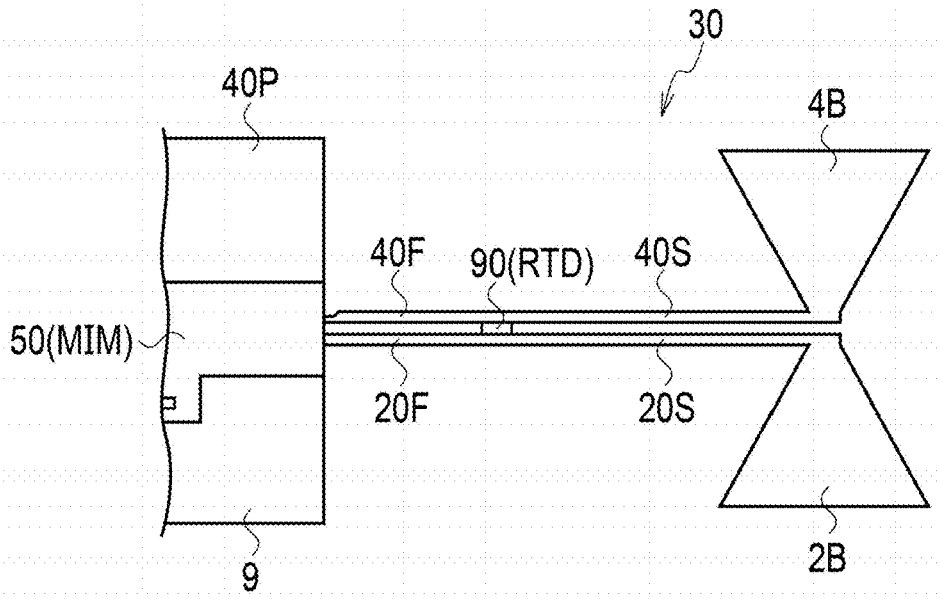
FIG. 3 is a schematic planar pattern configuration diagram enlarging a neighborhood of a resonator unit, an RTD unit, and an antenna unit, in the THz device according to the first embodiment (example of the bow tie antenna).

FIG. 3 is a schematic planar pattern configuration enlarging a neighborhood of the resonator unit, the RTD unit, and the antenna unit, in the THz device according to the first embodiment (example of the bow tie antenna).

Figure 4:
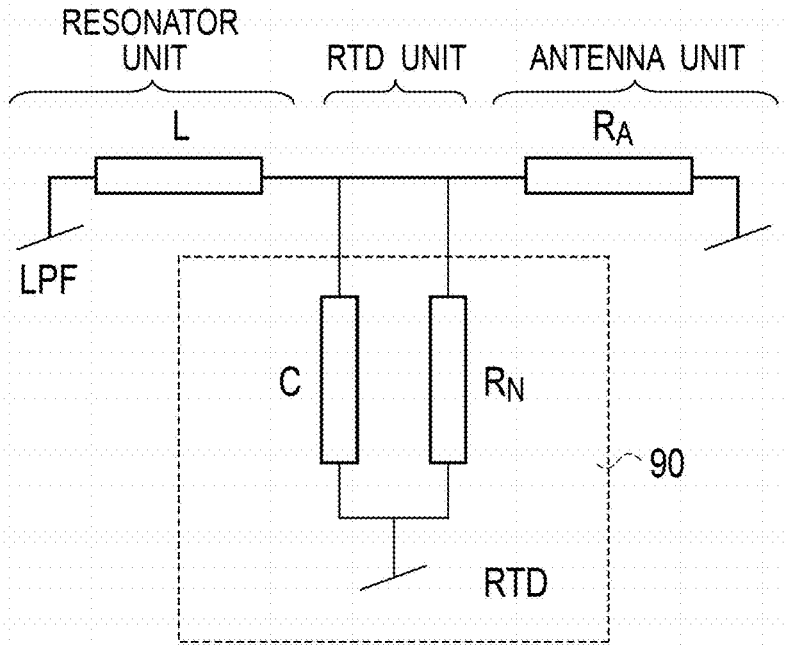
FIG. 4 is a schematic equivalent circuit configuration diagram showing a portion corresponding to FIG. 3, in the THz device according to the first embodiment.

FIG. 4 shows a schematic equivalent circuit configuration of a portion corresponding to FIG. 3, in the THz device according to the first embodiment. In FIG. 4, L denotes an inductance of the resonator unit, C denotes an electrostatic capacity of the RTD, $R_A$ denotes an antenna resistance, and $R_N$ denotes a negative resistance of the RTD.

Resonance conditions are expressed with the following equation (2):

$$1/j\omega L+j\omega C=0, R_A \| R_N <= 0 \quad (2)$$

where || denotes a parallel combined resistance.

The oscillation frequency $f_0$ is expressed with the following equation (3):

$$f_0=1/2\pi\sqrt{C} \quad (3)$$

Fundamentally, the oscillation frequency $f_0$ is determined by adjusting the resonator unit.

Figure 5:
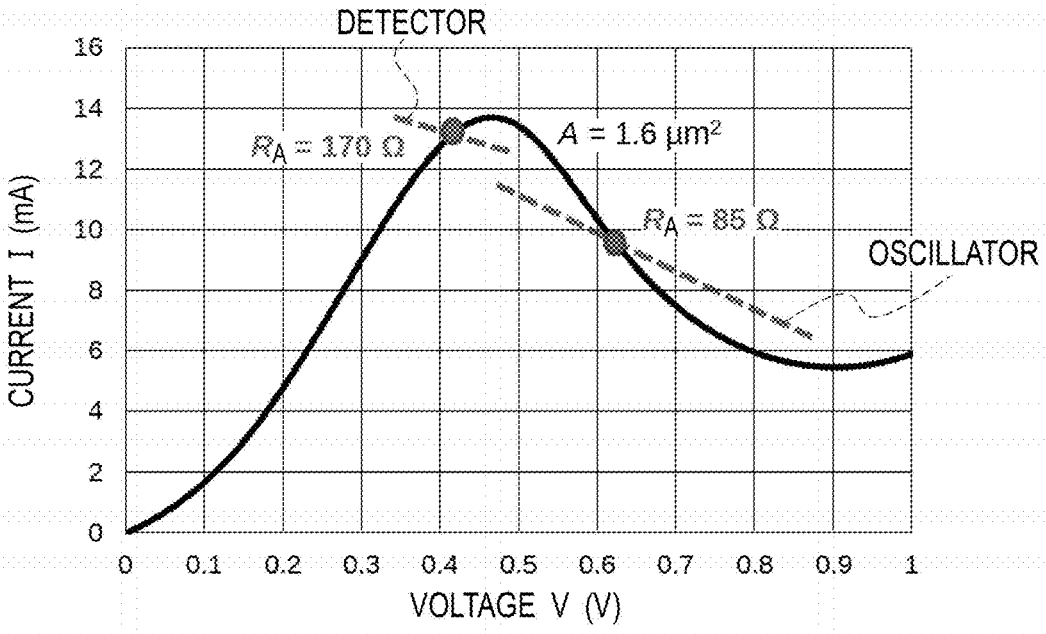
FIG. 5 shows an example of current-voltage characteristics of RTD, in the THz device according to the first embodiment.

FIG. 5 shows an example of current-voltage characteristics of RTD, in the THz device according to the first embodiment.

Detecting operation (non-oscillation) conditions as the detector are expressed with the following equation (4):

$$R_A \| R_N > 0 \quad (4)$$

Oscillation operation conditions as the oscillator are expressed with the following equation (5):

$$R_A \| R_N <= 0 \quad (5)$$

(Simulation Result of Antenna Resistance $R_A$ and Oscillation Detection Efficiency)

FIG. 5 shows an example of current-voltage characteristics of RTD applied as the active element, in the THz device according to the first embodiment.

Figure 6:
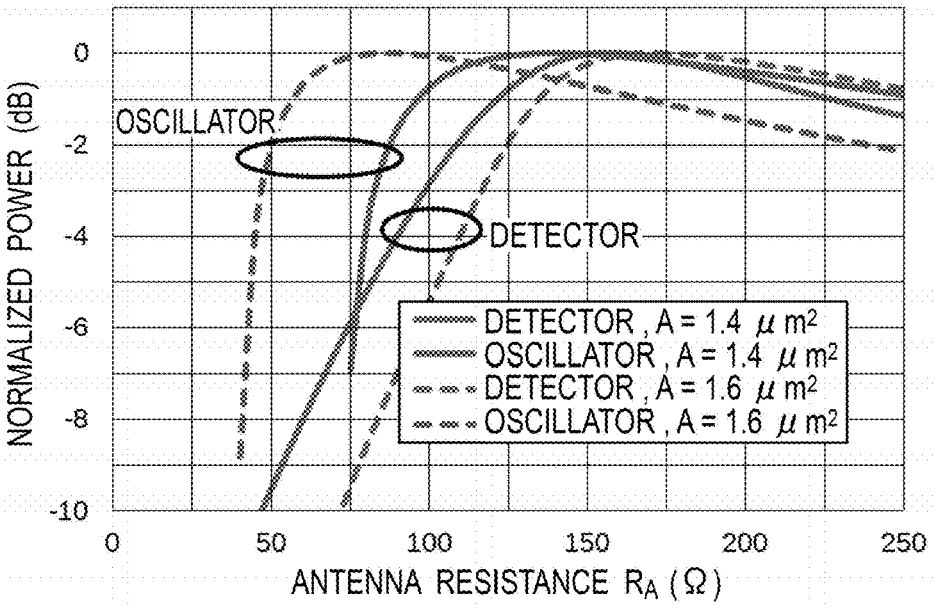
FIG. 6 shows a simulation result of a relationship between a normalized power and antenna resistance, as an oscillator and a detector, in the THz device according to the first embodiment.

FIG. 6 shows a simulation result of a relationship between a normalized power and antenna resistance, as the oscillator and the detector, in the THz device according to the first embodiment.

Figure 7:
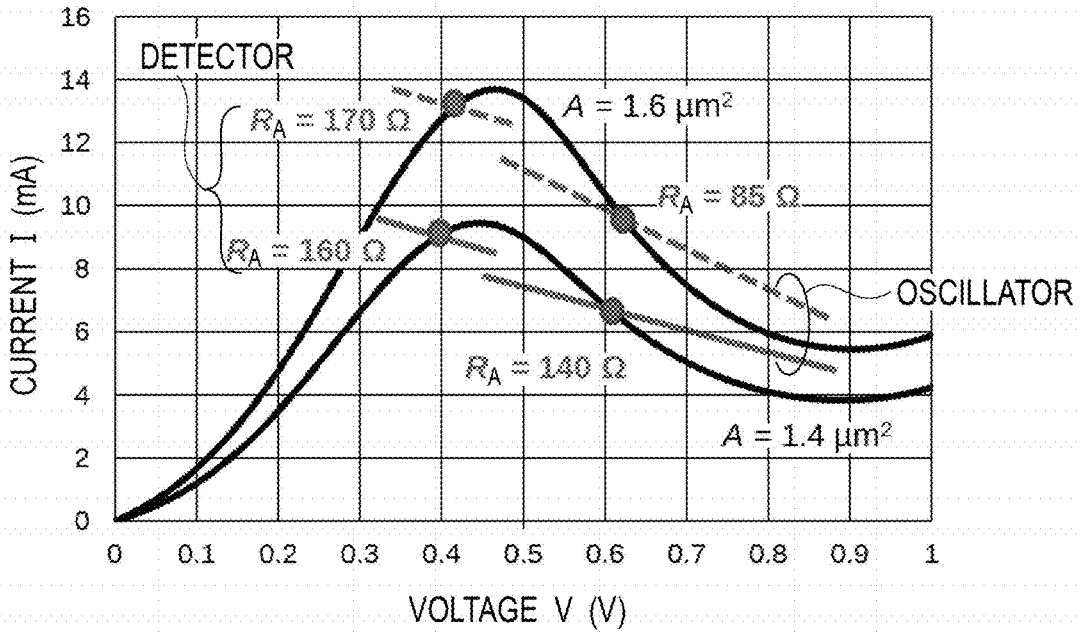
FIG. 7 shows an example of bias conditions as the oscillator and the detector using the antenna resistance as a parameter, in an example of the current-voltage characteristics of RTD, in the THz device according to the first embodiment.

FIG. 7 shows an example of bias conditions as the oscillator and the detector using the antenna resistance as a parameter, in an example of the current-voltage characteristics of RTD, in the THz device according to the first embodiment.

Figure 8:
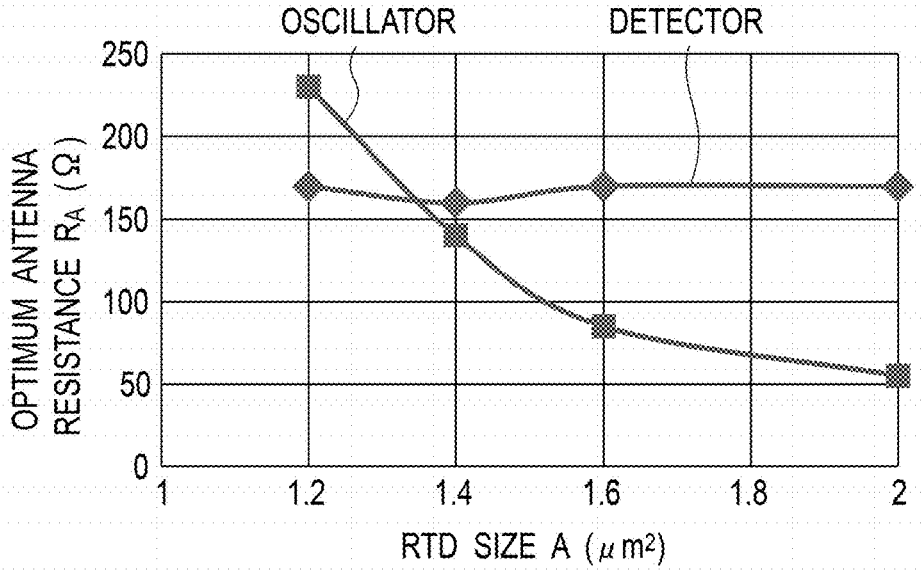
FIG. 8 shows a relationship between an optimum antenna resistance and an RTD size as the oscillator and the detector, in the THz device according to the first embodiment.

Furthermore, FIG. 8 shows a relationship between an optimum antenna resistance and an RTD size as the oscillator and the detector, in the THz device according to the first embodiment.

As shown in FIG. 8, with regard to an oscillation/detection efficiency, there is an optimum value in the antenna resistance in accordance with a size of RTD mesa. Moreover, the optimum antenna resistance as the oscillator is in inverse proportion to the element size. Moreover, the optimum antenna resistance as the detector is within a range from approximately 150Ω to approximately 200Ω, for example. In the RTD for THz operation, the size A of the mesa is preferably equal to or less than approximately 2.0 $\mu m^2$, for example. Moreover, an antenna having high resistivity equal to or larger than approximately 50Ω is advantageous to efficiency improvement, for example.

(Impedance Matching in Transmission Line)

Figure 9:
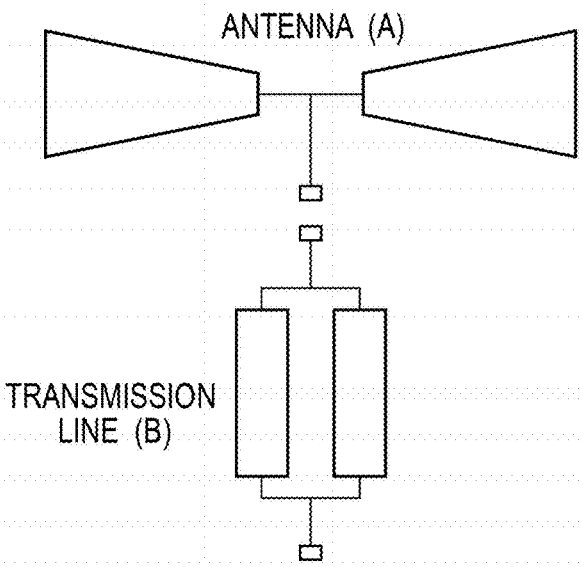
FIG. 9 shows an arrangement example of an ordinary planar antenna (A) and a transmission line (B).
Figure 10:
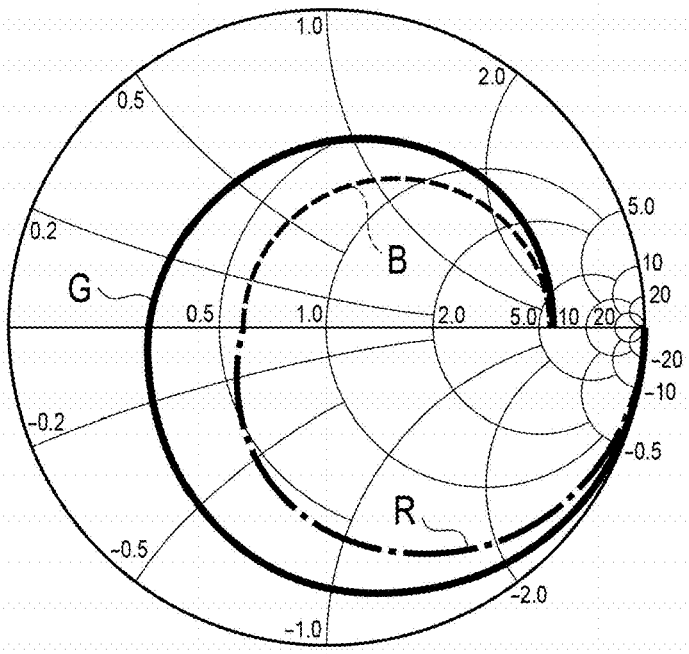
FIG. 10 is a Smith chart of the ordinary planar antenna (R), a Smith chart of the transmission line (B), and a Smith chart of an antenna (G) subjected to an impedance adjustment using the transmission line in the THz device according to the first embodiment.

FIG. 9 shows an arrangement example of an ordinary planar antenna (A) and transmission line (B). Moreover, FIG. 10 shows a Smith chart of the ordinary planar antenna (R), a Smith chart of the transmission line (B), and a Smith chart of an antenna (G) subjected to an impedance adjustment using the transmission line in the THz device according to the first embodiment.

Figure 11:
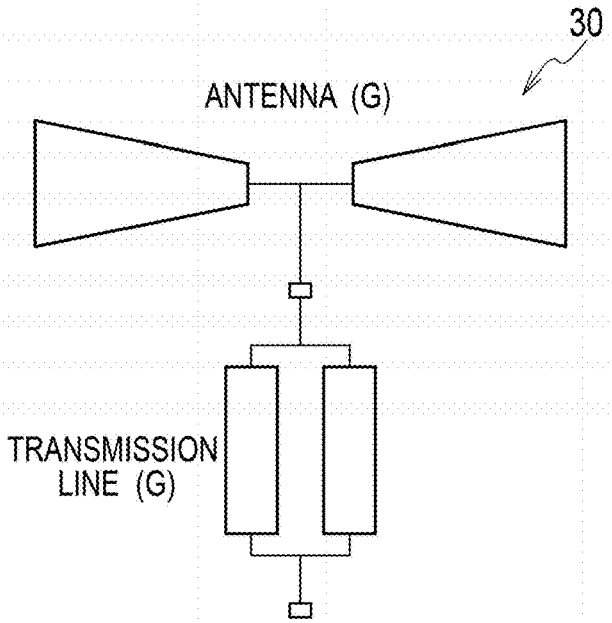
FIG. 11 shows an example of coupling arrangement the antenna (G) and the transmission line (G) subjected to the impedance adjustment, in the THz device according to the first embodiment.

FIG. 11 shows an example of coupling arrangement the antenna (G) and the transmission line (G) subjected to the impedance adjustment, in the THz device according to the first embodiment.

Figure 12:
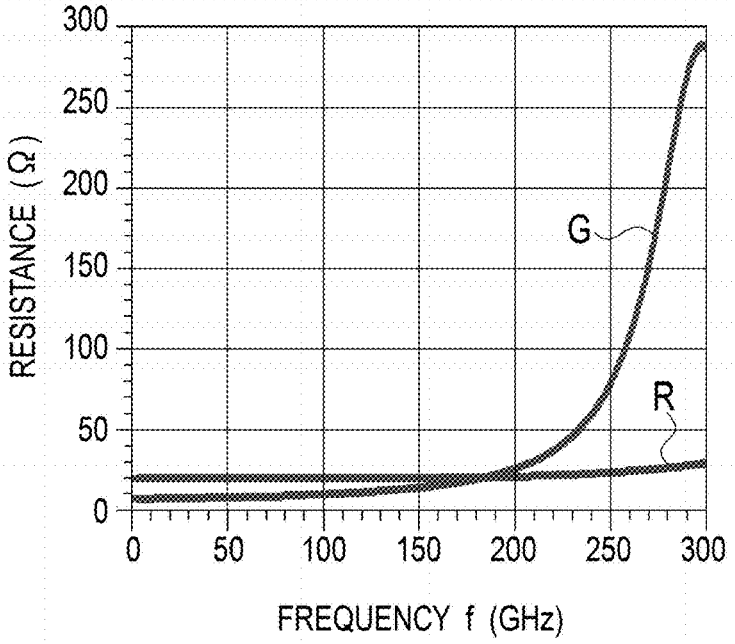
FIG. 12 shows a relationship between the resistor and the frequency each of the ordinary planar antenna (R) and the antenna (G) subjected to the impedance adjustment, in an explanatory diagram of the impedance adjustment with the transmission line.

Moreover, FIG. 12 shows a relationship between the resistor and the frequency each of the ordinary planar antenna (R) and the antenna (G) subjected to the impedance adjustment, in an explanatory diagram of the impedance adjustment with the transmission line.

An impedance conversion using the transmission line is expressed with the following equation (6):

$$Z_A = Z_0^2 / R_A \quad (6)$$

where $Z_0$ denotes a characteristic impedance of the transmission line.

(Example of Specific Size—Relationship Between Antenna and Transmission Line)

Figure 13A:
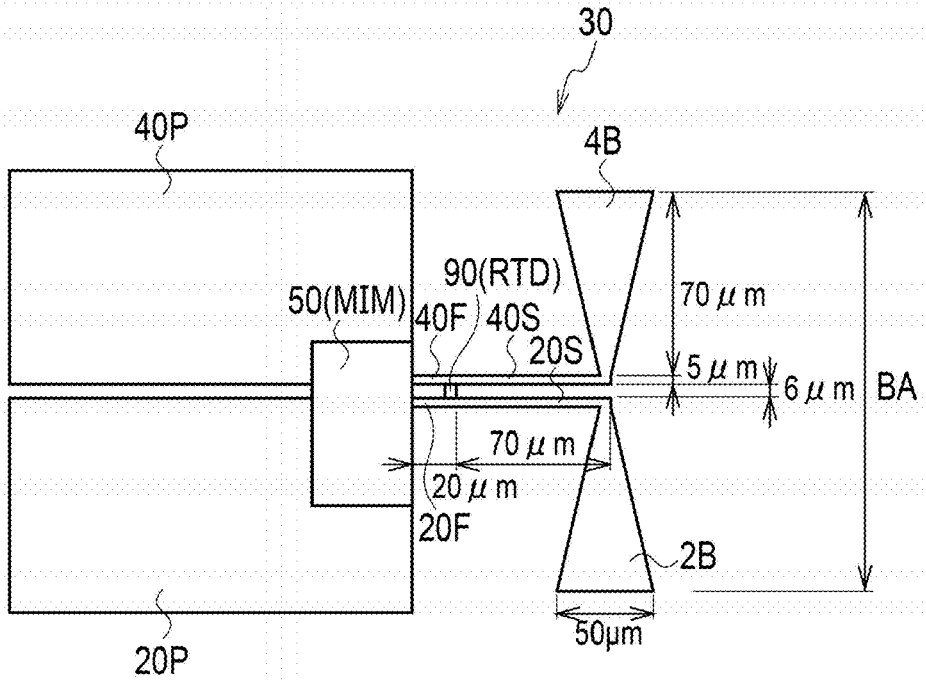
FIG. 13A shows an example of a specific structural dimension of the THz device according to the first embodiment (example of a bow tie antenna).
Figure 13B:
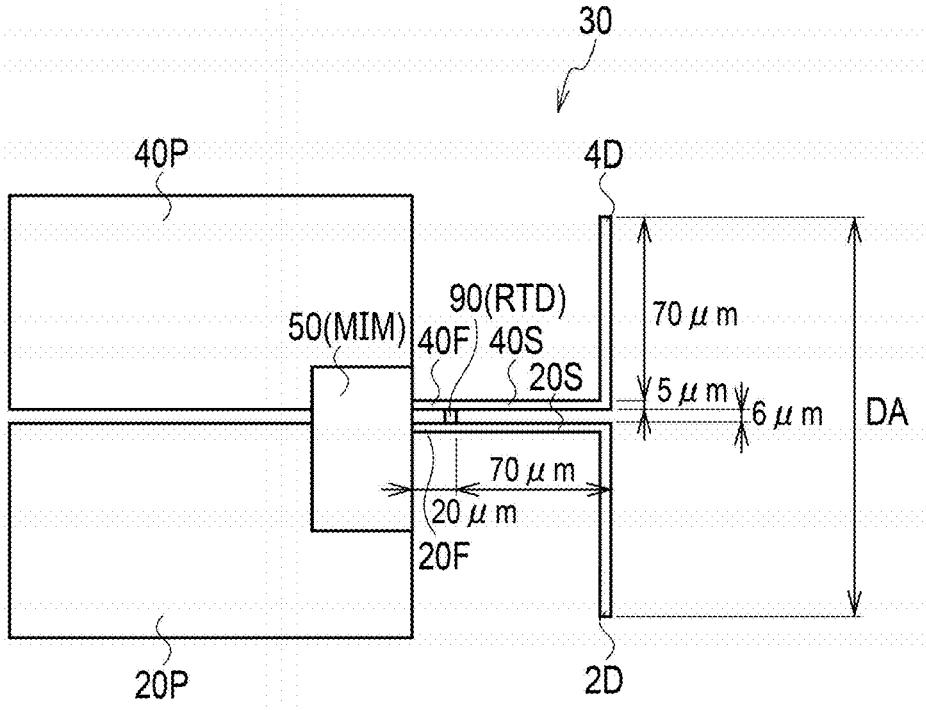
FIG. 13B shows an example of a specific structural dimension of the THz device according to the first embodiment (example of the dipole antenna).

Layouts (details of a matching circuit and an antenna portion) of the THz device according to the first embodiment (RTD oscillator) obtained in this way are shown hereinafter. More specifically, FIG. 13A shows an example of a bow tie antenna, as a specific example of a structural dimension of the THz device according to the first embodiment. FIG. 13B shows an example of a dipole antenna, as a specific example of a structural dimension of the THz device according to the first embodiment.

The antenna length BA is set as approximately ½ wavelength in consideration of a permittivity. That is, a radiation efficiency of the antenna becomes the maximum when the antenna length BA is ½ wavelength. If the antenna length BA is changed from ½ wavelength, the frequency can be adjusted by changing a length of the transmission line 20S. However, a radiation efficiency is reduced. Accordingly, the available antenna length BA of the bow tie antenna in the THz device according to the first embodiment is equal to or less than 1 wavelength. The antenna length DA of the dipole antenna is also the same thereas, and the antenna length DA is set as approximately ½ wavelength in consideration of the permittivity. The available antenna length DA of the dipole antenna in the THz device according to the first embodiment is equal to or less than 1 wavelength.

A resonator length (length of the transmission line 20F) is set as equal to or less than approximately ⅛ wavelength. It is effective to design the length having an inductance for resonating at designed frequencies. Generally, this is because the Q factor of the resonator is rapidly reduced if the resonator length is approximately ⅛ wavelength or more. The resonator length (the length of the transmission line 20F) is an element most sensitive to the resonant frequency, and therefore fine adjustment is required. The antenna length DA of the dipole antenna is also the same thereas.

The length of the transmission line 20S is set as approximately ¼ wavelength. More specifically, the antenna resistance $R_A$ can be converted to a target resistance value by adjusting the characteristic impedance of the transmission line 20S. For example, 40Ω can be converted to 250Ω. In the embodiments, the characteristic impedance $Z_0$ of the transmission line 20S is 100Ω. An admittance component resulting from the length of the transmission line 20S is smaller than that of the resonator unit and the RTD component, and an influence on the frequency is relatively small. The transmission line of the dipole antenna is also the same thereas.

Figure 14:
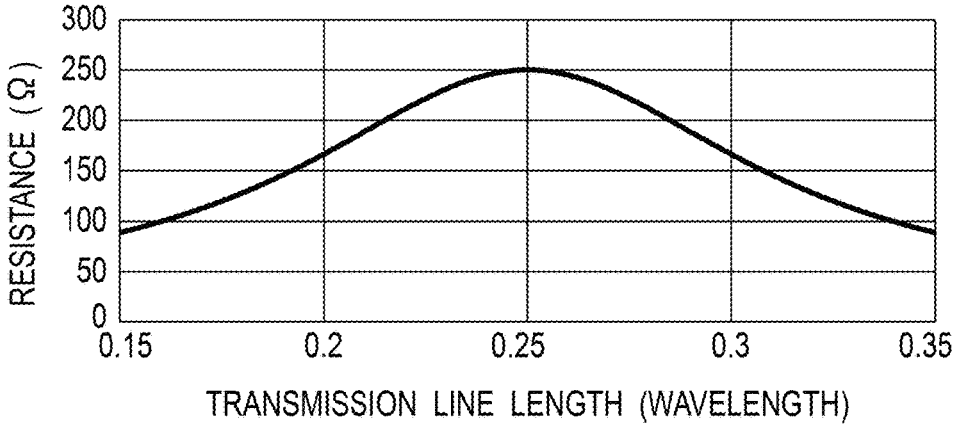
FIG. 14 shows a relationship between an input resistance and a transmission line length after impedance conversion of the bow tie antenna using the transmission line, in the THz device according to the first embodiment.

FIG. 14 shows a relationship between an input resistance and a transmission line length after impedance conversion of the bow tie antenna using the transmission line 20S, in the THz device according to the first embodiment. FIG. 14 shows a calculated result of an input resistance value after the impedance conversion of the bow tie antenna (original antenna resistance $R_A$=40Ω) using the transmission line 20S (characteristic impedance $Z_0$=100Ω). A reduction in the efficiency due to 20% error difference of the length of transmission line length is approximately 3 dB.

Figure 15:
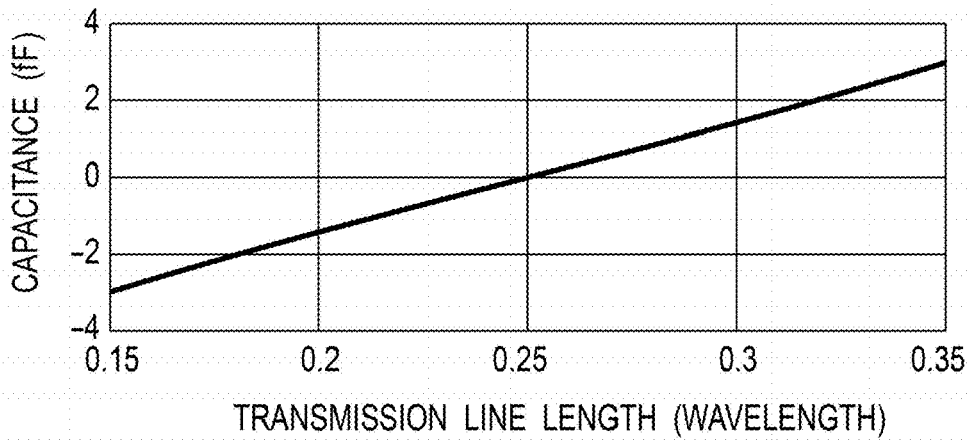
FIG. 15 shows a relationship between a capacitance and the transmission line length after the impedance conversion of the bow tie antenna using the transmission line, in the THz device according to the first embodiment.

FIG. 15 shows a relationship between a capacitance and the transmission line length after the impedance conversion of the bow tie antenna using the transmission line 20S, in the THz device according to the first embodiment. FIG. 15 shows a calculated result of a capacitance value after the impedance conversion of the bow tie antenna (original antenna resistance $R_A$=40Ω) using the transmission line 20S (characteristic impedance $Z_0$=100Ω). In the embodiments, the capacitance value of the RTD is approximately 10 fF to approximately 30 fF. A frequency change due to 20% error difference of the length of the transmission line length is $(1.5\ fF/15\ fF)^{1/2}$, and therefore is approximately 5%.

(Device Structure)

Figure 16:
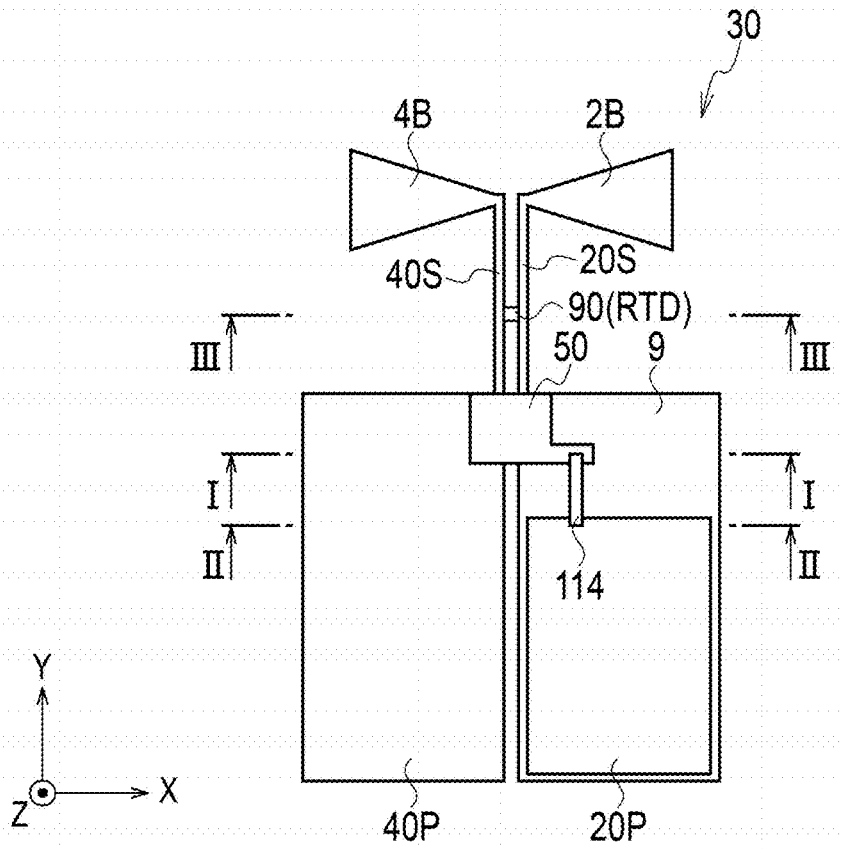
FIG. 16 is a schematic planar pattern configuration diagram of an implementation example of a fundamental metallic parallel resistance, in the THz device according to the first embodiment.

FIG. 16 shows a schematic planar pattern configuration of an implementation example of a fundamental metallic parallel resistance, in the THz device according to the first embodiment.

In the THz device according to the first embodiment, the device (including the resonator, the antenna, and the transmission line) can be fabricated by forming films of a semiconductor laminated structure for RTD on an InP substrate, and then patterning electrode wiring on each part thereof, for example.

Figure 17A:
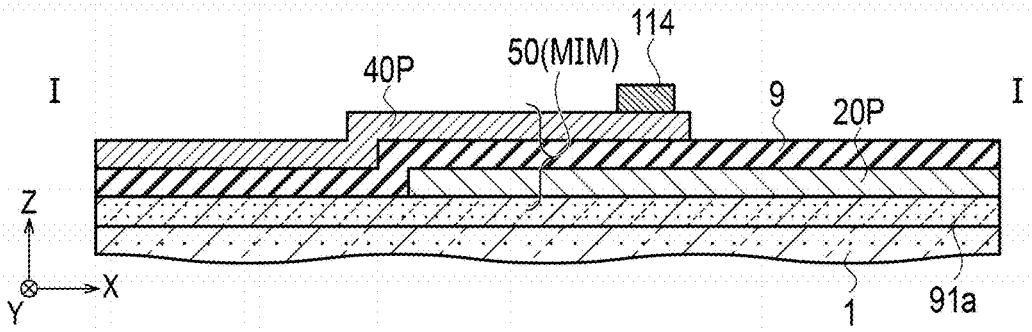
FIG. 17A is a schematic cross-sectional structure diagram taken in the line I-I of FIG. 16.
Figure 17B:
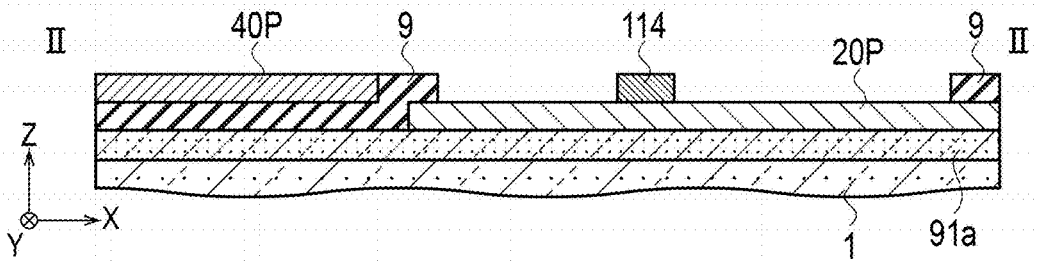
FIG. 17B is a schematic cross-sectional structure diagram taken in the line II-II of FIG. 16.
Figure 18:
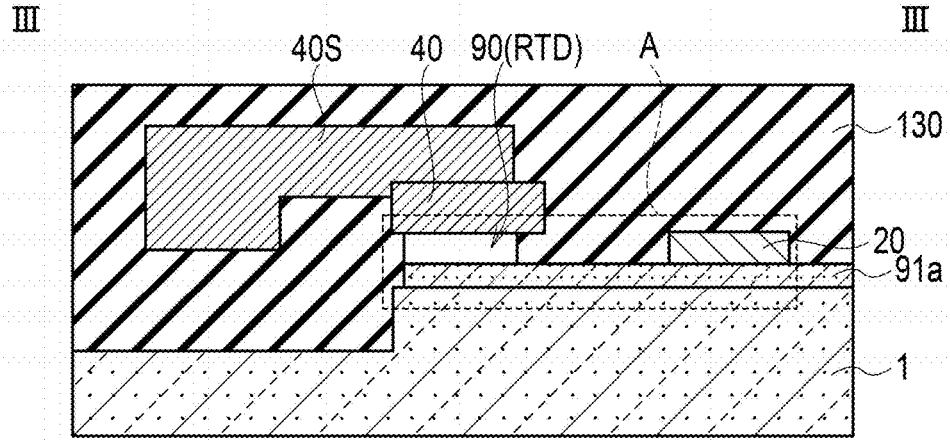
FIG. 18 is a schematic cross-sectional structure diagram taken in the line III-III in FIG. 16.

Moreover, FIG. 17A shows a schematic cross-sectional structure taken in the line I-I of FIG. 16, and FIG. 17B shows a schematic cross-sectional structure taken in the line II-II thereof. Moreover, FIG. 18 shows a schematic cross-sectional structure taken in the line III-III of FIG. 16. FIG. 19 shows an enlarged schematic cross-sectional structure of the portion A of FIG. 18. A directional relationship is as follows: A vertical direction is a Z-axial direction with respect to the device planar pattern in which the RID 90 is disposed, an extending direction along the transmission line in which the RTD 90 is disposed is a Y-axial direction, and a vertical direction with respect to the Y-axial direction is an X-axial direction.

(RTD)

As shown in FIG. 19, a constructional example of the RTD applicable to the THz device according to the first embodiment includes: an InGaAs layer 91*a* formed on a semiconductor substrate 1 composed including a semi insulating InP substrate, the InGaAs layer 91*a* highly doped with an n type impurity; an InGaAs layer 92*a* formed on the InGaAs layer 91*a*, the InGaAs layer 92*a* doped with an n type impurity; an undoped InGaAs layer 93*b* formed on the InGaAs layer 92*a*; a quantum well structure QW formed on the InGaAs layer 93*a*, the quantum well structure QW composed including an undoped AlAs layer 94*a*/an undoped InGaAs layer 95/an undoped AlAs layer 94*b*; an undoped InGaAs layer 93*b* formed on the undoped AlAs layer 94*b*; an InGaAs layer 92*a* formed on the InGaAs layer 93*a*, the InGaAs layer 92*a* doped with an n type impurity; an InGaAs layer 91*b* formed on the InGaAs layer 92*b*, the InGaAs layer 91*b* highly doped with an n type impurity; a first electrode 40 disposed on the GaInAs layer 91*b*; and a second electrode 20 disposed on the InGaAs layer 91*a*.

As shown in FIG. 19, the quantum well structure QW of the RTD 90 is formed so that the InGaAs layer 95 is inserted between the AlAs layers 94*a*, 94*b*. The quantum well structure QW layered in this way is ohmic-connected the electrodes 40, 20, by intervening the undoped InGaAs layers 93*a*, 93*b*, via the n-type InGaAs layers 92*a*, 92*b* and the n-type highly doped InGaAs layers 91*a*, 91*b*.

In this case, the thickness of each layer is, for example, as follows:

The thicknesses of the highly doped n-type InGaAs layers 91*a*, 91*b* are respectively approximately 400 nm and approximately 15 nm, for example. The thicknesses of the n-type GaInAs layers 92*a*, 92*b* are substantially equivalent to each other, and are respectively approximately 25 nm, for example. The thicknesses of the undoped InGaAs layers 93*a*, 93*b* are respectively from approximately 2 nm to approximately 20 nm, for example. The thicknesses of the AlAs layers 94*a* and 94*b* are equal to each other, and respectively are approximately 1.1 nm, for example. The thickness of the InGaAs layer 95 is approximately 4.5 nm, for example.

In addition, an $SiO_2$ film, an $Si_3N_4$ film, a SiON film, an $HfO_2$ film, an $Al_2O_3$ film, etc., or an interlayer insulating film 130 composed including the aforementioned multilayer films is deposited on the sidewall part of the layered structure shown in FIG. 19. The interlayer insulating film 130 can be formed by using a Chemical Vapor Deposition (CVD) method or a sputtering technique.

Due to the layered structure composed including the metal/insulator/metal of the MIM reflector 50, the pad electrodes 40P, 20P are short-circuited in terms of high frequencies. Moreover, the MIM reflector 50 produces an effect to reflect high-frequency waves as it is open in terms of direct current.

Each of the first electrode 40 and the second electrode 20 is composed including a metal layered structure of Au/Pd/Ti, for example, and the Ti layer is a buffer layer for making satisfactory a contact state with the semiconductor substrate 1 including a semi insulating InP substrate. The thickness of each unit of the first electrode 40 and the second electrode 20 is approximately several 100 nm, for example, and a planarized layered structure is produced as a whole. Each of the first electrode 40 and the second electrode 20 can be formed by a vacuum evaporation method or a sputtering technique.

The insulation layer of the MIM reflector can be formed including a $SiO_2$ film, for example. Other films, e.g. an $Si_3N_4$ film, a SiON film, an $HfO_2$ film, an $Al_2O_3$ film, etc. are also applicable to the interlayer insulating film. In addition, the thickness of the insulating layer can be determined in consideration of a geometric plane size of the MIM reflector 50 and a required capacitor value on circuit characteristics, for example, and may be set to several 10 nm to several 100 nm. The insulating layer can be formed by CVD or a spattering technique.

In the THz device 30 according to the embodiments, although an example of the first tunnel barrier layer/quantum well layer/second tunnel barrier layer has a configuration of AlAs/InAlAs/AlAs is shown, it is not limited to such materials. For example, an example of the first tunnel barrier layer/quantum well layer/second tunnel barrier layer having a configuration of AlGaAs/GaAs/AlGaAs may be suitable therefor. Alternatively, an example of the first tunnel barrier layer/quantum well layer/second tunnel barrier layer having a configuration of AlGaN/GaN/AlGaN may be suitable therefor. Alternatively, an example of the first tunnel barrier layer/quantum well layer/second tunnel barrier layer having a configuration of SiGe/Si/SiGe may be suitable therefor.

As shown in FIG. 19, the THz device 30 according to the first embodiment may include: a semiconductor substrate 1; a first semiconductor layer 91*a* disposed on the semiconductor substrate 1; a second electrode 20 connected to a one side of a main electrode of the active element 90 formed so as to be layered on the first semiconductor layer 91*a*, the second electrode 20 connected to the first semiconductor layer 91*a* and disposed on the semiconductor substrate 1; and a first electrode 40 connected to another side of the main electrode of the active element 90, the first electrode 40 disposed on the semiconductor substrate 1 so as to be opposite to the second electrode 20. The first electrode 40 and the second electrode 20 are respectively connected to the first transmission lines 40S, 20S.

Although the RTD applied to the THz device 30 according to the first embodiment is typical as the active element 90, the active element 90 can compose also from the diodes and transistors except the RTD. As other active elements, for example, a Tunnel Transit Time (TUNNETT) diode, an Impact Ionization Avalanche Transit Time (IMPATT) diode, a GaAs-based Field Effect Transistor (FET), a GaN-based FET, a High Electron Mobility Transistor (HEMT), a Heterojunction Bipolar Transistor (HBT), a Complementary Metal-Oxide-Semiconductor (CMOS) FET, etc. are also applicable thereto.

(Antenna Structure)

Antennas in which planar integration is available, e.g. a bow tie antenna, a dipole antenna, a slot antenna, a patch antenna, and a Yagi-Uda antenna, are applicable to the THz device 30 according to the embodiments, for example.

The insulation layer of MIM reflector 50 can be formed including an $SiO_2$ film, for example. Other films, e.g. an $Si_3N_4$ film, a SiON film, an $HfO_2$ film, an $Al_2O_3$ film, etc. are also applicable to the insulating film. In addition, the thickness of the insulating layer can be determined in consideration of a geometric plane size of the MIM reflector 50 and a required capacitor value on circuit characteristics, for example, and may be set to several 10 nm to several 100 nm. The insulation layer can be formed by using CVD or a sputtering technique.

(Fabrication Method)

In a fabrication method of the THz device 30 according to the first embodiment, the device (including the resonator, the antenna, and the transmission line) can be fabricated by forming films of a semiconductor laminated structure for an active element (RTD) on an InP substrate, and then patterning electrode wiring on each part thereof, for example.

(Parallel Resistance with Semiconductor Layer)

FIG. 20 shows a schematic planar pattern configuration of an example of forming a parallel resistance 114S with a semiconductor layer, in the THz device according to the first embodiment. Moreover, FIG. 21 shows a schematic cross-sectional structure taken in the line IV-IV of FIG. 20. In the embodiments, the parallel resistance 114S including a semiconductor layer can be formed by patterning the semiconductor layer (n+ InGaAs layer 91*a*) disposed on the semi-insulating InP substrate 1.

In the example of forming the parallel resistance 114S with the n+ InGaAs layer 91*a*, since the n+ InGaAs layer 91*a* is disposed below the electrodes 40P, 20P (i.e., a substrate side), it is shown with the dashed line, as shown in FIG. 20, on the planar pattern.

Moreover, an underlying of the semiconductor layer (n+ InGaAs layer 91*a*) is a semi-insulating InP substrate 1. The n+ InGaAs layer 91*a* formed on the semi-insulating InP substrate 1 is used for the parallel resistance 114S. A resistance value depends on conduction properties (doping concentration, etc.) of the n+ InGaAs layer 91*a*. It is adjustable by trimmings, e.g. the width and length, so as to become a target resistance value on the basis of the surface resistance value of the n+ InGaAs layer 91*a*.

Figure 22:
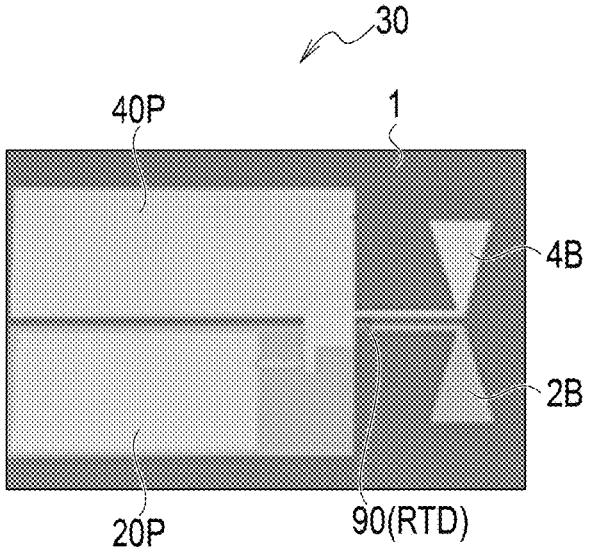
FIG. 22 shows an example of a microphotograph of a surface of a fabricated device, in the THz device according to the first embodiment.

FIG. 22 shows an example of a microphotograph of a surface of the fabricated device, in the THz device according to the first embodiment. The THz device according to the first embodiment can be operated also as the RTD detector, or also as the RTD oscillator.

According to the first embodiment, there can be provided the THz device capable of the high-efficiency matching between the active element and the antenna due to the impedance conversion effect of the transmission line.

Second Embodiment

Figure 23A:
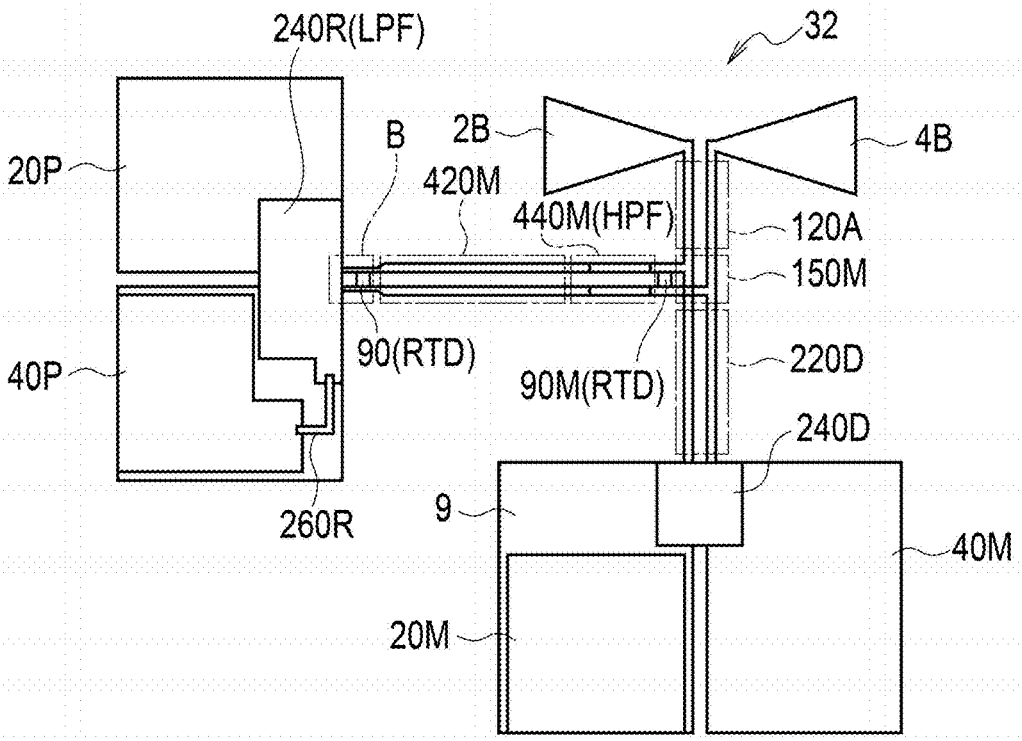
FIG. 23A is a schematic planar pattern configuration diagram of the THz integrated circuit according to a second embodiment (example of a bow tie antenna).
Figure 23B:
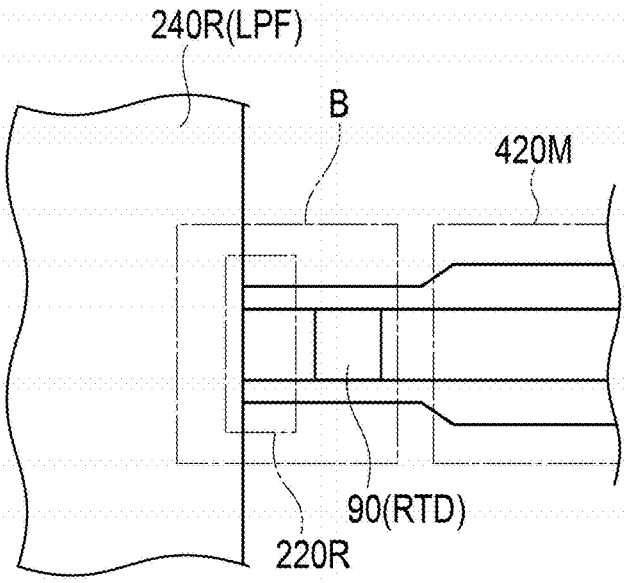
FIG. 23B is an enlarged view of a neighborhood of the portion B of FIG. 23A.

FIG. 23A shows a schematic planar pattern configuration diagram of the THz integrated circuit 32 according to the second embodiment (example of a bow tie antenna), and FIG. 23B shows an enlarged view of a neighborhood of the portion B of FIG. 23A.

As shown in FIGS. 23A and 23B, the THz integrated circuit 32 according to the second embodiment includes: antenna electrodes 4B, 2B capable of transmitting and receiving a THz wave to/from free space; first transmission lines 120A capable of transmitting the THz wave, the first transmission lines 120A respectively connected to the antenna electrodes 4B, 2B; third transmission lines 220D capable of transmitting the THz wave, the third transmission lines 220D respectively connected to the first transmission lines 120A; second pad electrodes 40M, 20M respectively connected to the third transmission lines 220D; a second low-pass filter 240D with respect to the THz wave, the second low-pass filter 240D connected to the second pad electrodes 40M, 20M; a second active device 90M of which a main electrode is connected to the third transmission lines 220D via a branch unit 150M; fourth transmission lines 420M capable of transmitting the THz wave, the fourth transmission lines 420M connected to the second active device 90M; a first active device of which a main electrode is connected to the fourth transmission lines 420M, the first active device 90 disposed on the fourth transmission lines 420M so as to be isolated from the second active device 90M; second transmission lines 220R capable of transmitting the THz wave, the second transmission lines 220R connected to the first active device 90; first pad electrodes 40P, 20P respectively connected to the second transmission lines 220R; and a first low-pass filter 240R with respect to the THz wave, the first low-pass filter 240R connected to the first pad electrodes 40P, 20P. In the embodiments, impedance matching of between the antenna electrodes 4B, 2B and the active elements 90, 90M can be realized by an impedance conversion of the first transmission lines 120A.

The fourth transmission lines 420M may include a high-pass filter 440M with respect to the THz wave.

Moreover, the first low-pass filter 240R and the second low-pass filter 240D may include an MIM reflector.

Moreover, a parallel resistance 260R connected between the first pad electrodes 40P, 20P may be provided. A metal resistor, a semiconductor layer, etc. can be applied as the parallel resistance element, in the same manner as that of the first embodiment.

Although the example of the bow tie antenna is shown as the antenna electrodes 4B, 2B, a dipole antenna, a slot antenna, a patch antenna, a ring antenna, or a Yagi-Uda antenna may be provided, as other examples, in the same manner as that of the first embodiment.

The THz integrated circuit 32 according to the second embodiment can be formed on the semiconductor substrate 1, in the same manner as the THz device 30 according to the first embodiment.

More specifically, in the same manner as FIG. 19, the THz integrated circuit 32 according to the second embodiment may include: a semiconductor substrate 1; a first semiconductor layer 91*a* disposed on the semiconductor substrate 1; a second electrode 20 connected to a one side of a main electrode of the first active element 90 formed so as to be layered on the first semiconductor layer 91*a*, the second electrode 20 connected to the first semiconductor layer 91*a* and disposed on the semiconductor substrate 1; and a first electrode 40 connected to another side of the main electrode of the first active element 90, the first electrode 40 disposed on the semiconductor substrate 1 so as to be opposite to the second electrode 20. In the embodiments, the first electrode 40 and the second electrode 20 are respectively connected to the second transmission lines 220R and the fourth transmission lines 420M.

Moreover, in the THz integrated circuit 32 according to the second embodiment, the second active device 90M can be composed, in the same manner as the first active device 90. The main electrode of the second active device 90M is connected to the third transmission lines 220D and the fourth transmission lines 420M.

(Block Configuration)

Figure 24:
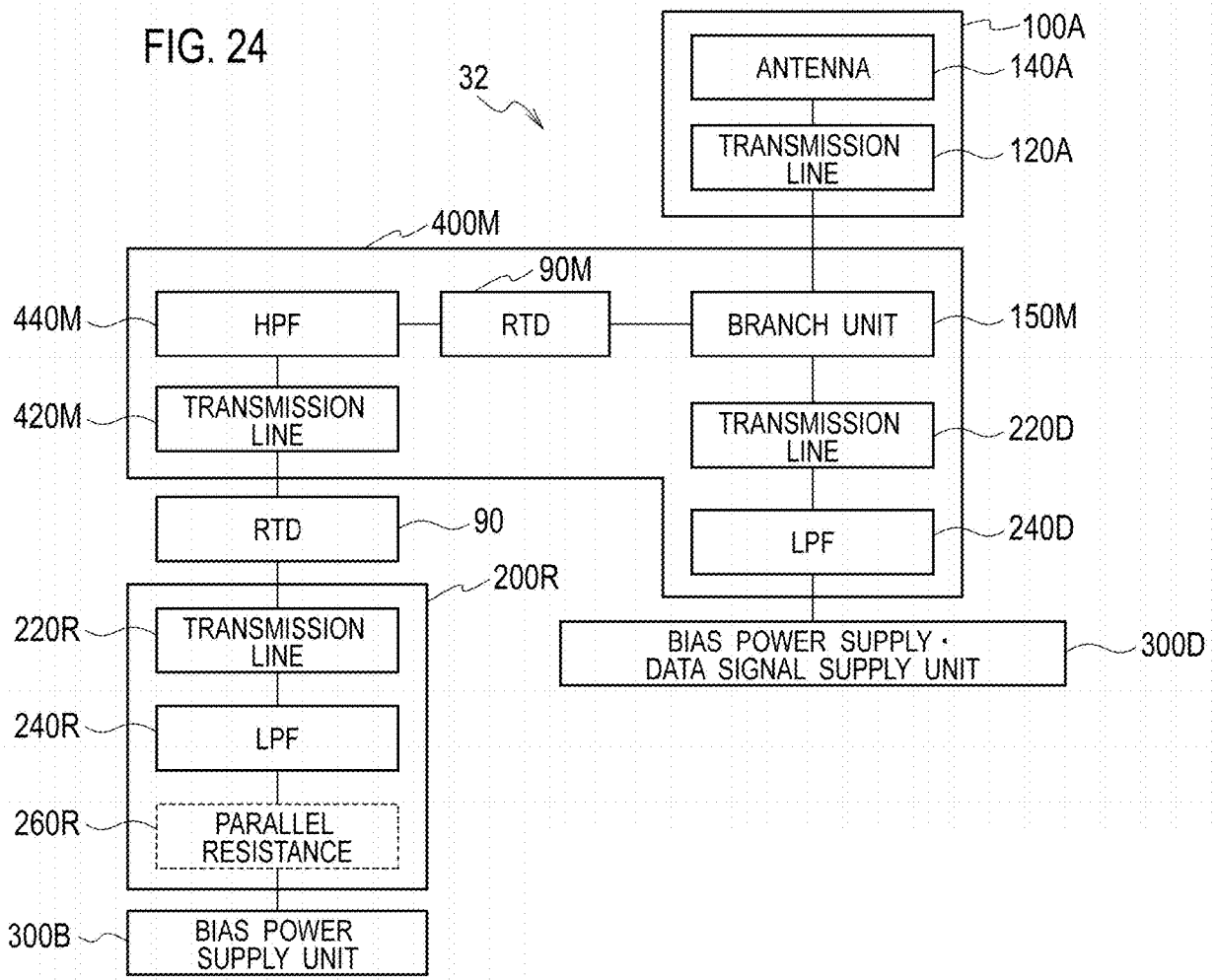
FIG. 24 is a schematic block configuration diagram of the THz integrated circuit according to the second embodiment.

FIG. 24 shows a schematic block configuration of the THz integrated circuit 32 according to the second embodiment.

As shown in FIG. 24, the THz integrated circuit 32 according to the second embodiment includes: an antenna unit 100A including an antenna 140A capable of transmitting and receiving a THz wave to free space, and a first transmission line 120A connected to the antenna 140A; a mixer unit 400M connected to the antenna unit 100A; a first active element 90 capable of transmitting and receiving the THz wave, the first active element 90 connected to the first transmission line 120A via the mixer unit 400M; and resonator unit 200R including a second transmission line 220R for supplying an electric power to the first active element 90, the second transmission line 220R connected to the first active element 90, and a first low-pass filter 240R with respect to the THz wave, the first low-pass filter 240R connected to the second transmission line 220R. In the embodiments, impedance matching of between the antenna 140A and the first active element 90 can be realized by an impedance conversion of the first transmission line 120A.

Moreover, the mixer unit 400M may include: a second active device 90M capable of transmitting and receiving the THz wave, the second active device 90M connected to the first transmission line 120A; a third transmission line 220D for supplying the electric power to the second active device 90M, the third transmission line 220D connected to the second active device 90M; a second low-pass filter 240D with respect to the THz wave, the second low-pass filter 240D connected to the third transmission line 220D; a high-pass filter 440M with respect to the THz wave, the high-pass filter 440M connected to the second active device 90M; and a fourth transmission line 420M connected to the second active device 90M via the high-pass filter 440M. In the embodiments, impedance matching of between the antenna 140A and the second active element 90M can be realized by an impedance conversion of the first transmission line 120A.

Moreover, a bias power supply unit 300B for supplying a bias power to the first active device 90 may further be provided, wherein the bias power supply unit 300B is connected to the resonator unit 200R.

Moreover, there may be further provided a bias power supply & data signal supply unit 300D for supplying the bias power and data signals to the second active device 90M, wherein the bias power supply and data signal supply unit 300D is connected to the mixer unit 400M.

An first branch unit 150M may further be provided, and the second active device 90M and the third transmission line 220D may be connected to the first transmission line 120A via the first branch unit 150M.

In the THz integrated circuit 32 according to the second embodiment, the mixer unit 400M is functioned as a frequency converter using the nonlinear characteristics of the second active device 90M, and a resonator unit 200R is functioned as a local oscillator.

In the THz integrated circuit according to the second embodiment, the data signals are mixed with the THz wave in the resonator unit 200R, and thereby a modulation/demodulation can be realized.

(Fabrication Method)

Also in the THz integrated circuit according to the second embodiment, the device (including the resonator, the mixer, the antenna, and the transmission line) can be fabricated by forming films of a semiconductor laminated structure for an active element (RTD) on an InP substrate, and then patterning electrode wiring on each part thereof, for example, in the same manner as the THz device according to the first embodiment.

(Higher-Order Modulation and Heterodyne Detection)

Since heterodyne detection is generally representation of the receiver method, a higher-order modulation is represented with regard to the transmitter, and heterodyne is represented with regard to the receiver.

Unlike direct amplitude modulation methods (e.g., Amplitude Modulation (AM modulation), Amplitude-Shift Keying (ASK), or On-Off Keying (OOK)), the higher-order modulation is a method as transmitters on a communications technology for achieving high transmitting efficiencies in the same frequency bandwidth by modulating both of the phase and the amplitude. For the purpose of efficient higher-order modulations of RF signals, an oscillating-signal source is provided aside from a data signal path, and a modulator, e.g. a mixer, modulates the phase and amplitude of the RF band oscillating signals. Higher-order modulations with a high-efficiency can be realized, in the THz integrated circuit according to the second embodiment.

The heterodyne detection is a method as receivers on communications technologies which are compared with an envelope detection method of amplitude-modulated signals. The heterodyne detection is a method of providing An oscillating-signal source of a receiver itself independently with received signals from antennas, and a demodulator, e.g. a mixer, converts frequencies of the received signals into desired bands in order to detect the signals. The heterodyne detection with a high-efficiency can also be realized, in the THz integrated circuit according to the second embodiment.

In the THz integrated circuit according to the second embodiment, both of the higher-order modulation and the heterodyne detection can be realized.

In the THz integrated circuit according to the second embodiment, an independent electrode port can be provided to each of the two RTDs 90, 90M. Consequently, two RTDs 90, 90M can separately be driven as the RTD 90 for local oscillators and the RTD 90M for mixers.

Although a layered structure is commonly used for the RTD 90 of the resonator portion and the RTD 90M of the mixer portion, a size of the chip may be formed so as to be different from each other. Two RTDs 90, 90M do not need to be the same sizes, and area structure in which an independent design is available. When increasing the amount of current in order to achieve higher-powered signal source of a local oscillator, it is effective to enlarge the mesa area and to increase the amount of current. Since capacity becomes larger and therefore the oscillation frequency is reduced in that case, the oscillation frequency can be tuned up to the higher-frequency side by designing the inductance of a feed line to be decreased.

Since sensitivity is important for the mixer, a noise is preferable to be reduced. In that case, since a shot noise is reduced if the amount of current can be made smaller, it can cope with reduction of the mesa area. In this case, it is not necessary to take into consideration a size of the RTD 90 at a side of a local-signal source. That is, the RTD 90 of the resonator unit 200R and the RTD 90M of the mixer unit 400M may be separately designed. Although a precise tuning is difficult in a structure having only one RTD, since an independent electrode port can be provided to each of the two RTDs 90, 90M in the THz integrated circuit according to the second embodiment, respective precise tuning can be achieved.

Accordingly, a plurality of functional elements using a plurality of the active elements (RTD) can also be integrated, in the THz integrated circuit according to the second embodiment. In the THz integrated circuit according to the second embodiment, implementation of the higher-order modulation transmitter and the heterodyne detection receiver can also be realized.

Figure 25:
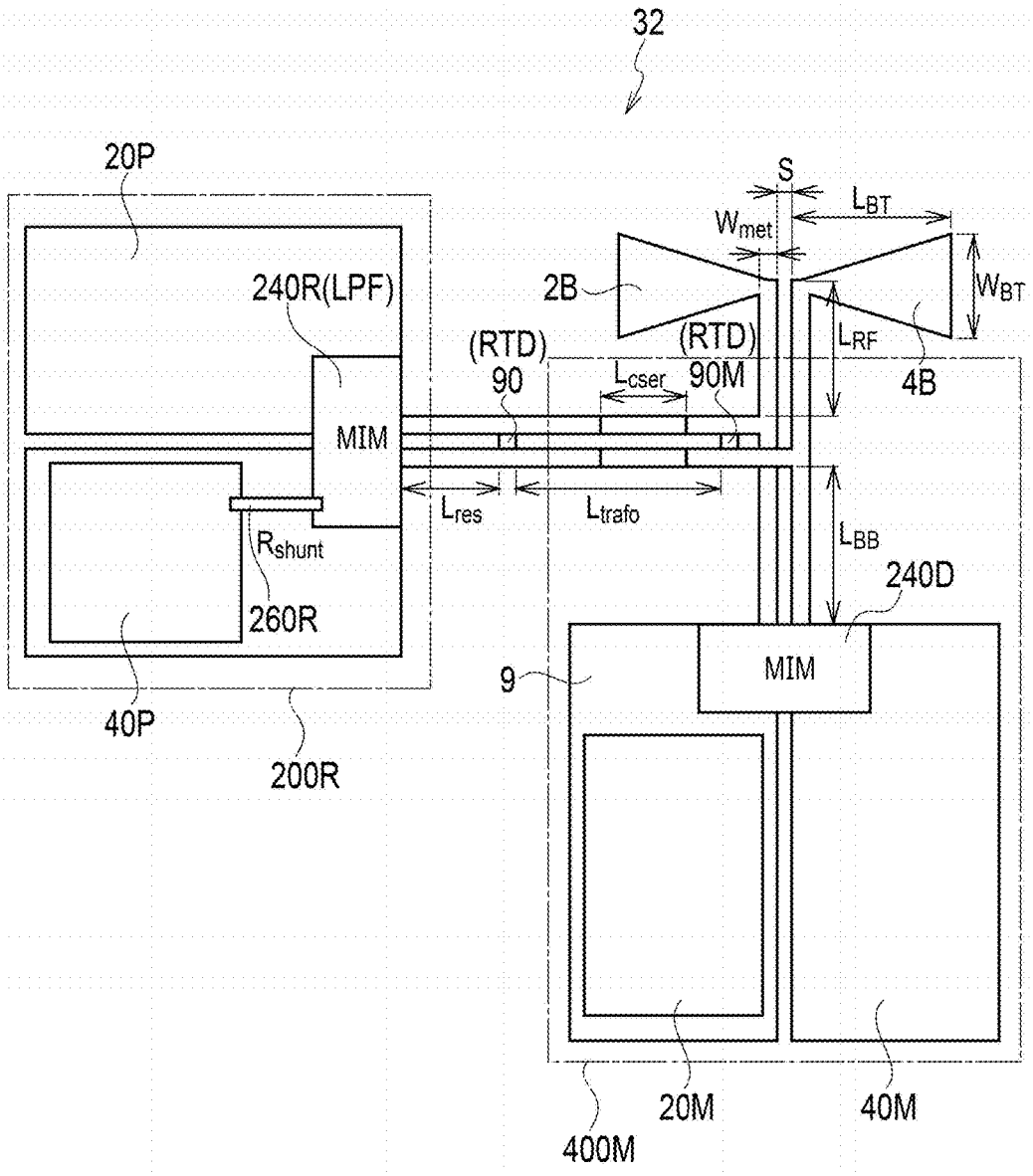
FIG. 25 is an explanatory diagram of a structural dimension of a schematic planar pattern configuration, in the THz integrated circuit according to the second embodiment (example of the bow tie antenna).

FIG. 25 shows an explanatory diagram of a structural dimension of a schematic planar pattern configuration, in the THz integrated circuit according to the second embodiment (example of the bow tie antenna).

A bow tie edge width of the antenna portion is expressed with $W_{BT}$. The bow tie edge width $W_{BT}$ is preferable to be designed so as to be wider for broader bandwidths, and is equal to or smaller than ¼ wavelength, for example.

The interval between the transmission lines is expressed with S, and the width of the transmission line is expressed with $W_{met}$. The distance of the transmission line from the $L_{PF}$ 240D to the branching is expressed with $L_{BB}$, and the distance of the transmission line from the branching to the antenna is expressed with $L_{RF}$. The distance of the transmission line from the LPF 240R to the RTD 90 is expressed with $L_{res}$, and the distance of the transmission line from the RTD 90 to the RTD 90M is expressed with $L_{trafo}$. The distance of the transmission line of the High-Pass Filter (HPF) 440M portion is expressed with $L_{cser}$.

Figure 26:
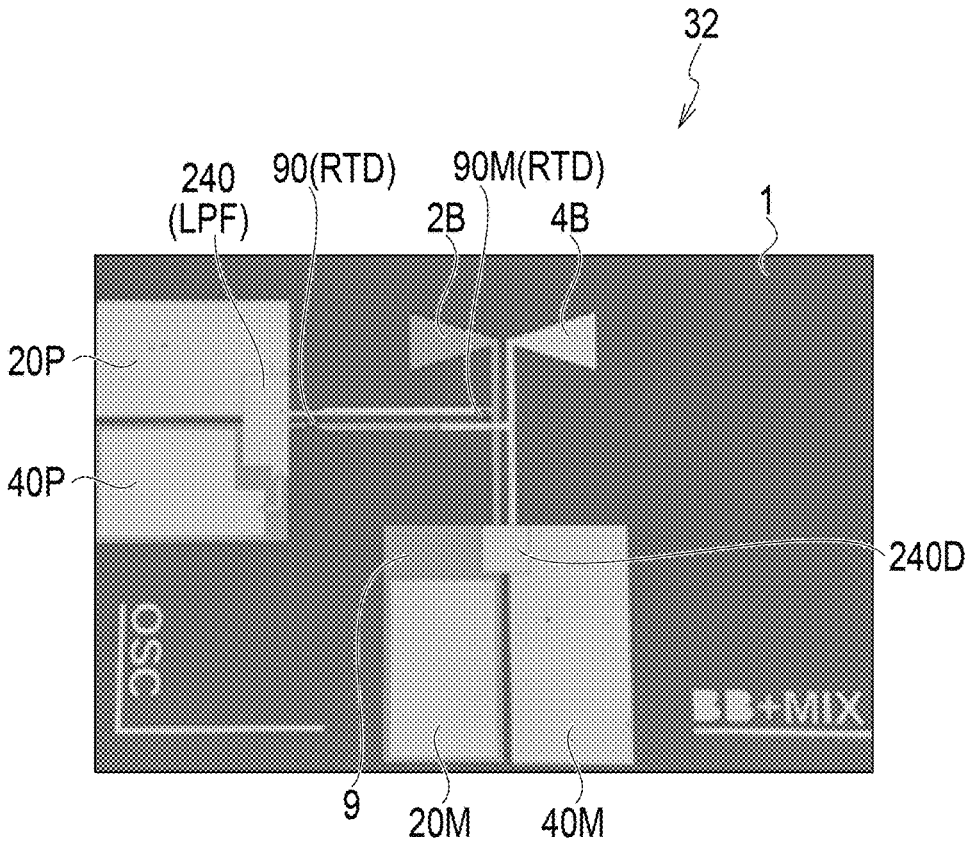
FIG. 26 shows an example of a microphotograph of a surface of a fabricated device, in the THz integrated circuit according to the second embodiment.

FIG. 26 shows an example of a microphotograph of a surface of the fabricated device, in the THz integrated circuit according to the second embodiment. The example of the photograph shown in FIG. 26 corresponds to the planar pattern configuration shown in FIG. 23 or 25.

(Antenna Gain)

Figure 27:
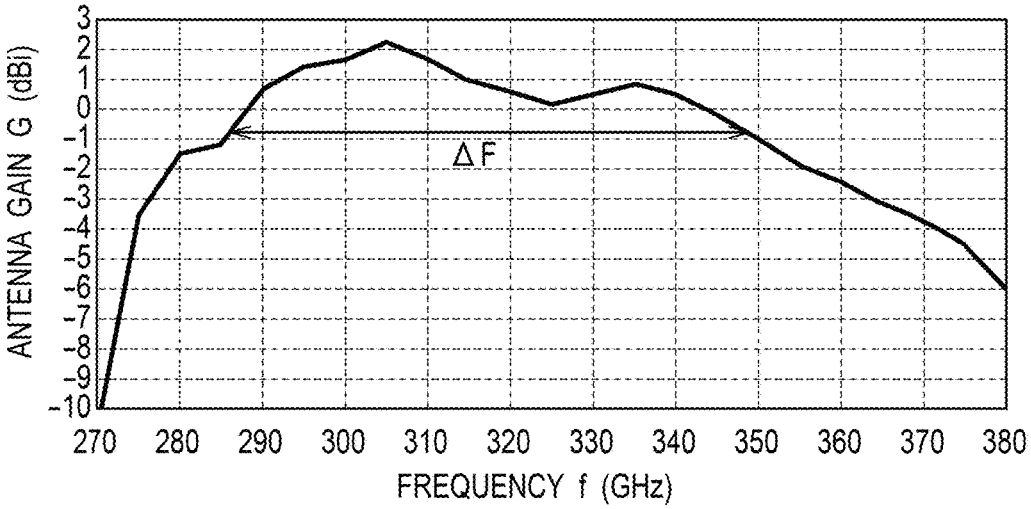
FIG. 27 shows an example of frequency characteristics of an antenna gain, in the THz integrated circuit according to the second embodiment.

FIG. 27 shows an example of frequency characteristics of an antenna gain, in the THz integrated circuit according to the second embodiment.

In the THz integrated circuit according to the second embodiment, as shown in FIG. 27, the broader-band characteristics of approximately 65 GHz or more are produced.

It is proved that high-efficiency matching between the RID and the antenna can be realized, also in the THz integrated circuit according to the second embodiment. More specifically, the distances to the RTD, the antenna, and the resonator unit are secured by applying the transmission lines, and the high-efficiency matching between the RTD and the antenna is realized due to the impedance conversion effect of the transmission lines, and thereby the broader-band characteristics of approximately 65 GHz or more can be produced.

(Electromagnetic Field Simulation)

Figure 28:
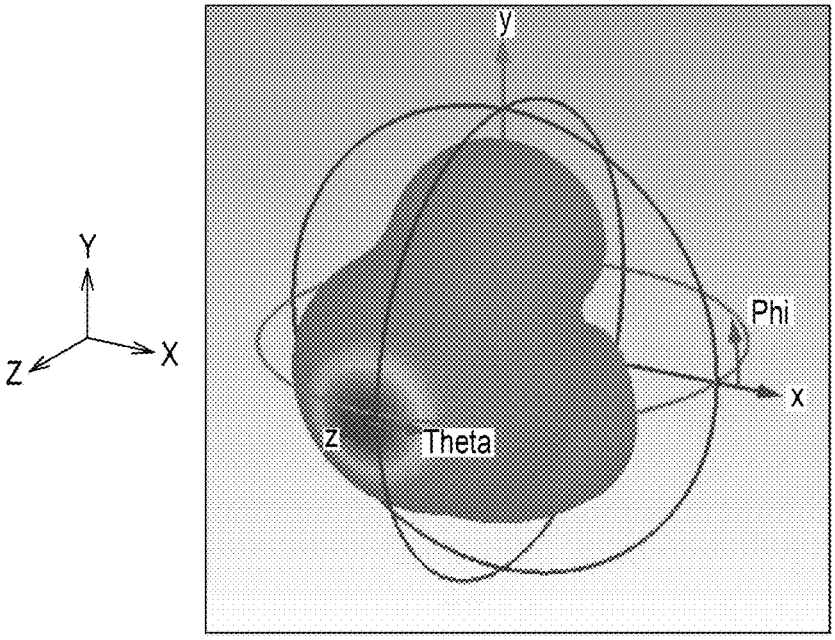
FIG. 28 shows a simulation result of a three-dimensional electromagnetic field radiation pattern, in the THz integrated circuit according to the second embodiment.

FIG. 28 shows a simulation result of a three-dimensional electromagnetic field radiation pattern of the RTD 90, in the THz integrated circuit according to the second embodiment. A vertical direction corresponds to a Z-axial direction with respect to the device planar pattern in which the RTD 90 is disposed, an extending direction along the transmission line in which the RTD 90 is disposed corresponds to a Y-axial direction, and a vertical direction with respect to the Y-axial direction corresponds to an X-axial direction. FIG. 28 shows the result of performing the simulation of the directivity at 300 GHz in the RTD device structure without a rear reflecting mirror as the RTD 90, in the THz integrated circuit according to the second embodiment, and no hemispherical lens is particularly disposed at a back side surface thereof. In the THz integrated circuit according to the second embodiment, a high directivity (antenna gain) can be obtained as shown in FIG. 28. In addition, a unimodal radiation pattern is obtained, as shown in FIG. 28.

(Measured Result)

Figure 29:
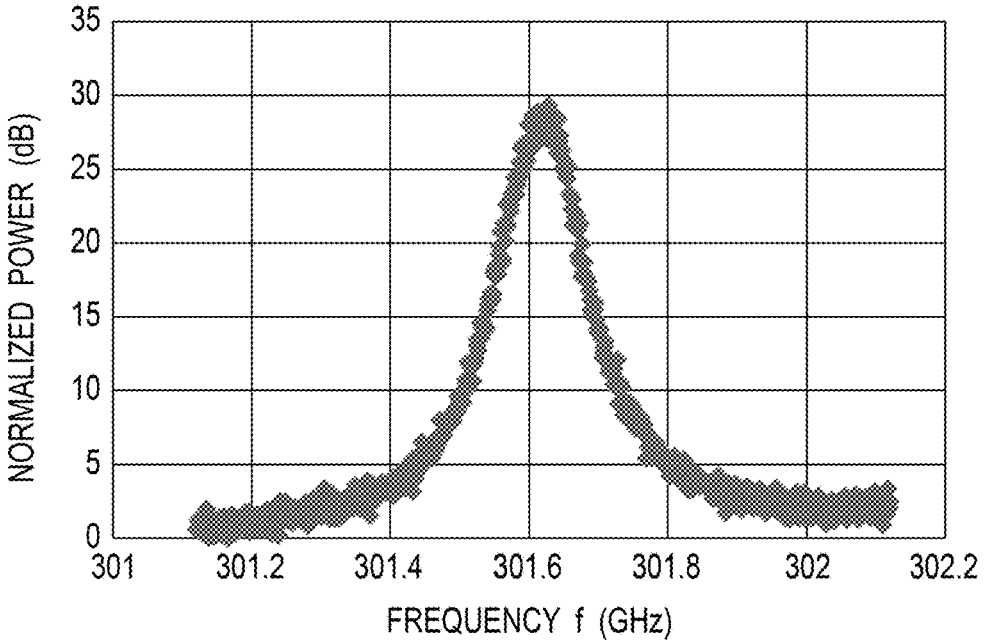
FIG. 29 shows a relationship between a normalized oscillation power and a frequency (spectrum) of a THz wave emitted from an antenna (without a mixer input signal), as a measured result of the fabricated device, in the THz integrated circuit according to the second embodiment.

FIG. 29 shows a relationship between a normalized oscillation power and a frequency (spectrum) of the THz wave emitted from the antenna (without a mixer input signal), as a measured result of the fabricated device, in the THz integrated circuit according to the second embodiment.

A 0.7-volt RTD bias voltage of the oscillator portion is set to negative resistance conditions. As a spectrum result of the THz wave emitted from the antenna (without mixer input signal), the normalized power of approximately 30 dB is obtained in a neighborhood of approximately 301.6 GHz, for example.

Figure 30:
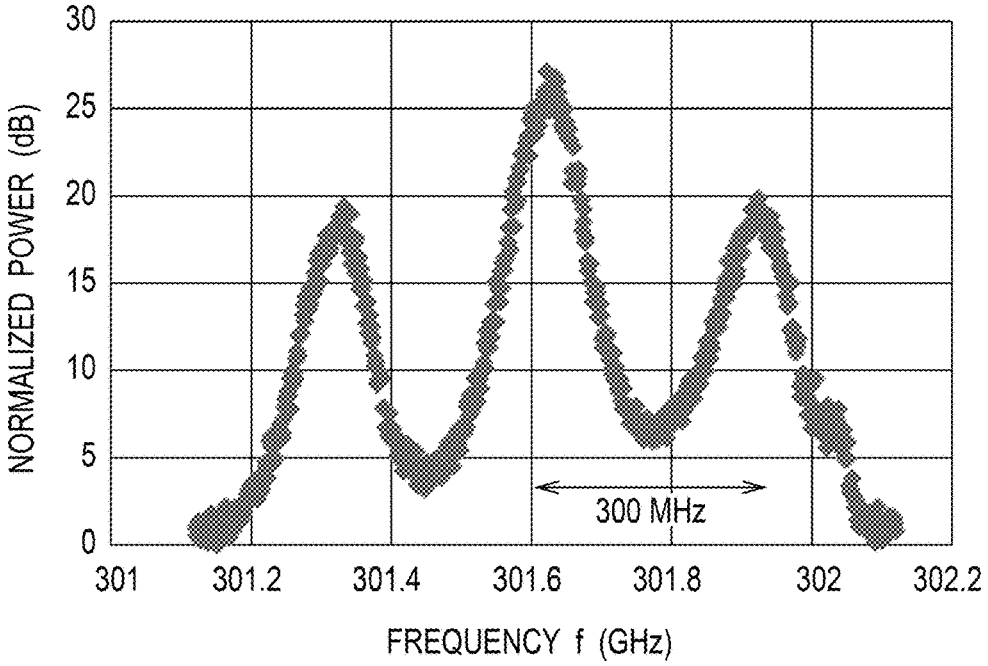
FIG. 30 shows a relationship between a normalized detection power and a frequency (spectrum) of a THz wave emitted from an antenna (with a mixer input signal), as a measured result of the fabricated device, in the THz integrated circuit according to the second embodiment.

FIG. 30 shows a relationship between a normalized detection power and a frequency (spectrum) of the THz wave emitted from the antenna (with a mixer input signal), as a measured result of the fabricated device, in the THz integrated circuit according to the second embodiment.

A 0.7-volt RTD bias voltage of the oscillator portion is set to negative resistance conditions.

A 0.4-volt RTD bias voltage of the mixer unit is set to conditions as an ordinary impedance. The modulation signal as shown in FIG. 30 is obtained, the modulation frequency of approximately 300 MHz is obtained, and the normalized power of approximately 20 dB is obtained, for example.

Application Example 1

Figure 31:
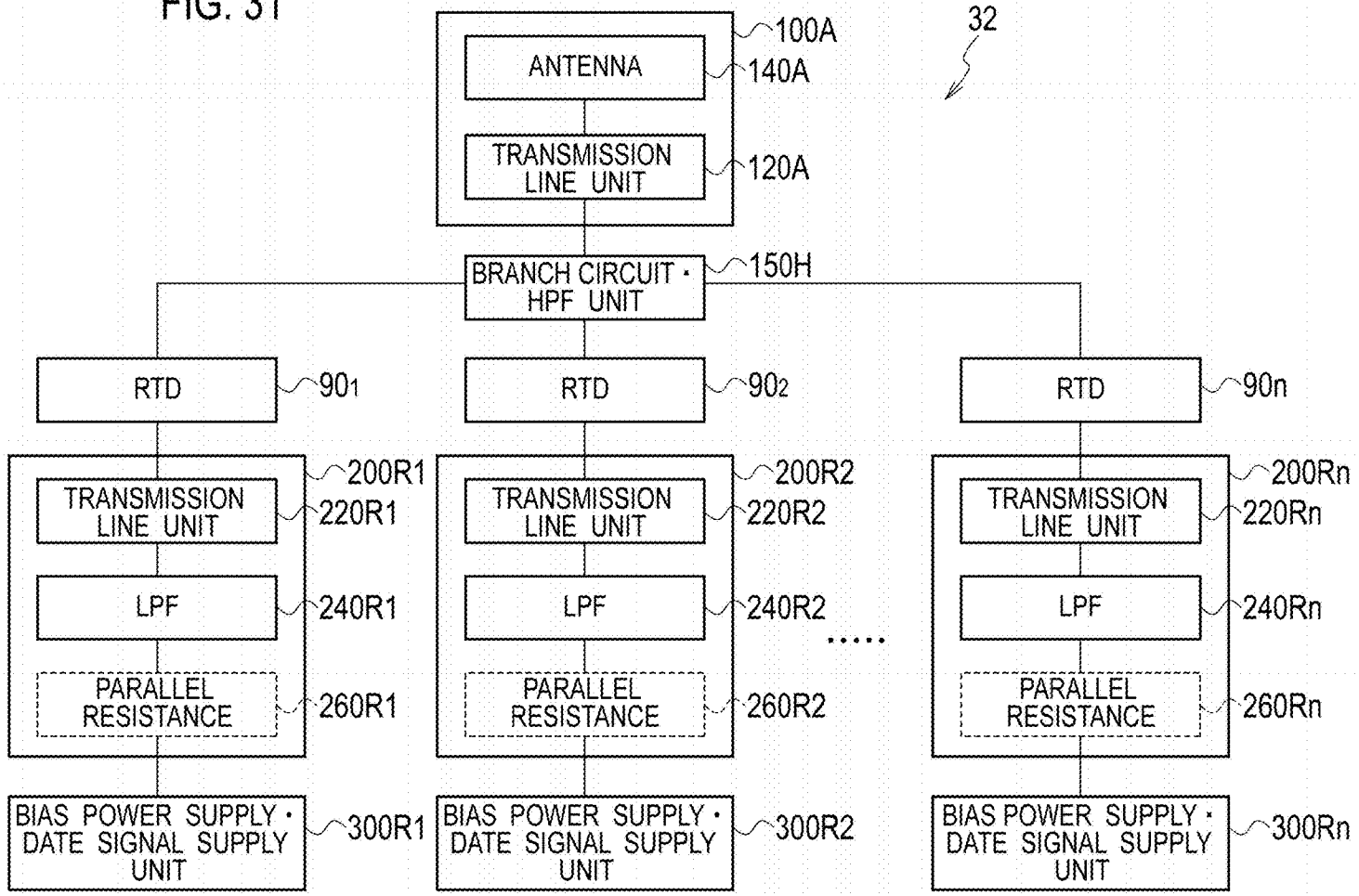
FIG. 31 is a schematic block configuration diagram of an example of arranging a plurality of resonator units so that a plurality of functional elements are arrayed, as an application example of structure, in the THz integrated circuit according to the second embodiment.

FIG. 31 shows a schematic block configuration of an example of arranging a plurality of resonator units so that a plurality of functional elements are arrayed, as an application example 1 of structure, in the THz integrated circuit 32 according to the second embodiment.

As shown in FIG. 31, the THz integrated circuit 32 according to the second embodiment may further include a branch circuit & HPF unit 150H having branching and HPF functions, and a plurality of active elements $\mathbf{90}_1$, $\mathbf{90}_2$, . . . , $\mathbf{90}_n$ may be connected to the antenna unit 100A via the branch circuit & HPF unit 150H.

Resonator units 200R1, 200R2, . . . , 200Rn are respectively connected to the plurality of the active elements $\mathbf{90}_1$, $\mathbf{90}_2$, . . . , $\mathbf{90}_n$. Bias power supply & data signal supply units 300R1, 300R2, . . . , 300Rn for supplying the bias power and transmitting/receiving data signals may be connected to the resonator unit 200R1, 200R2, . . . , 200Rn.

In the THz integrated circuit 32 according to the second embodiment, although a plurality of the resonator units 200R1, 200R2, . . . , 200Rn are disposed in the application example 1 of structure, it is selectable whether a common resonator unit is used or an individual resonator unit is used, in accordance with a use purpose. One example corresponds to a case of arranging the same resonator unit and synthesizing an output so as to be improved. As another example, signals of a plurality of frequencies can also be multiplexed by arranging an individual resonator unit. Both of a configuration of a monolithic one-chip and a hybrid configuration of integrating a plurality of chips can be realized.

Application Example 2

Figure 32:
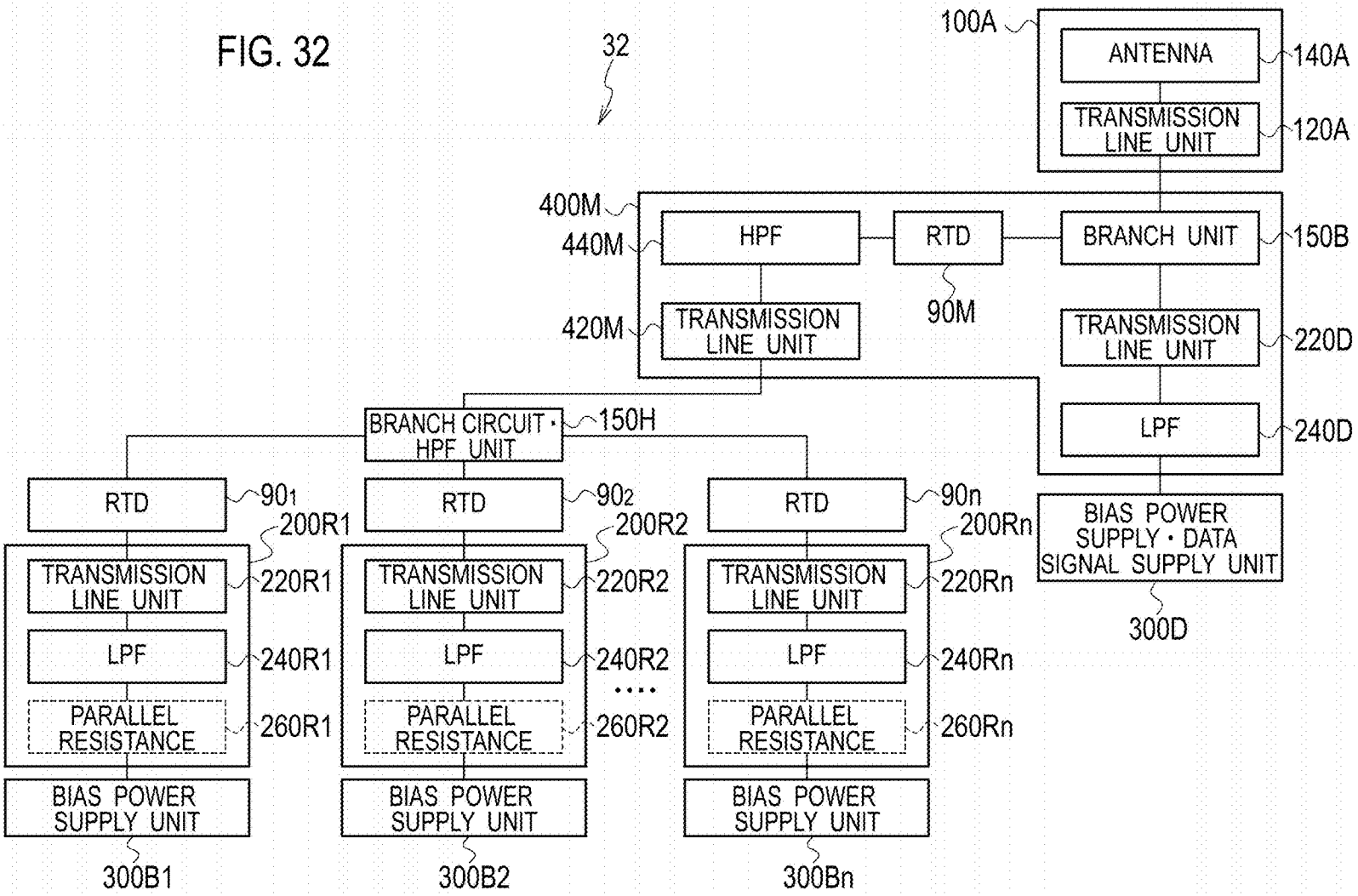
FIG. 32 is a schematic block configuration diagram of an example of arranging a plurality of the resonator units, and enabling branching and coupling to a mixer unit so that a plurality of oscillation device arrays is capable of realizing a high power, as an application example of structure, in the THz integrated circuit according to the second embodiment.

FIG. 32 shows a schematic block configuration of an example of arranging a plurality of the resonator units, and enabling branching and coupling to a mixer unit so that a plurality of oscillation device arrays is capable of realizing a high power, as an application example 2 of structure, in the THz integrated circuit 32 according to the second embodiment.

As shown in FIG. 32, the THz integrated circuit 32 according to the second embodiment may further include a branch circuit & HPF unit 150H having branching and HPF functions, and a plurality of active elements $\mathbf{90}_1$, $\mathbf{90}_2$, . . . , $\mathbf{90}_n$ may be connected to the mixer unit 400M via the branch circuit & HPF unit 150H.

Resonator units 200R1, 200R2, . . . , 200Rn are respectively connected to the plurality of the active elements $\mathbf{90}_1$, $\mathbf{90}_2$, . . . , $\mathbf{90}_n$. Bias power supply units 300B1, 300B2, . . . , 300Bn for supplying a bias power may be connected to the resonator units 200R1, 200R2, . . . , 200Rn.

In the THz integrated circuit 32 according to the second embodiment, although a plurality of the resonator units 200R1, 200R2, . . . , 200Rn are disposed in the application example 2 of structure, it is selectable whether a common resonator unit is used or an individual resonator unit is used, in accordance with a use purpose. One example corresponds to a case of arranging the same resonator unit and synthesizing an output so as to be improved. As another example, signals of a plurality of frequencies can also be multiplexed by arranging an individual resonator unit. Both of a configuration of a monolithic one-chip and a hybrid configuration of integrating a plurality of chips can be realized.

Application Example 3

Figure 33:
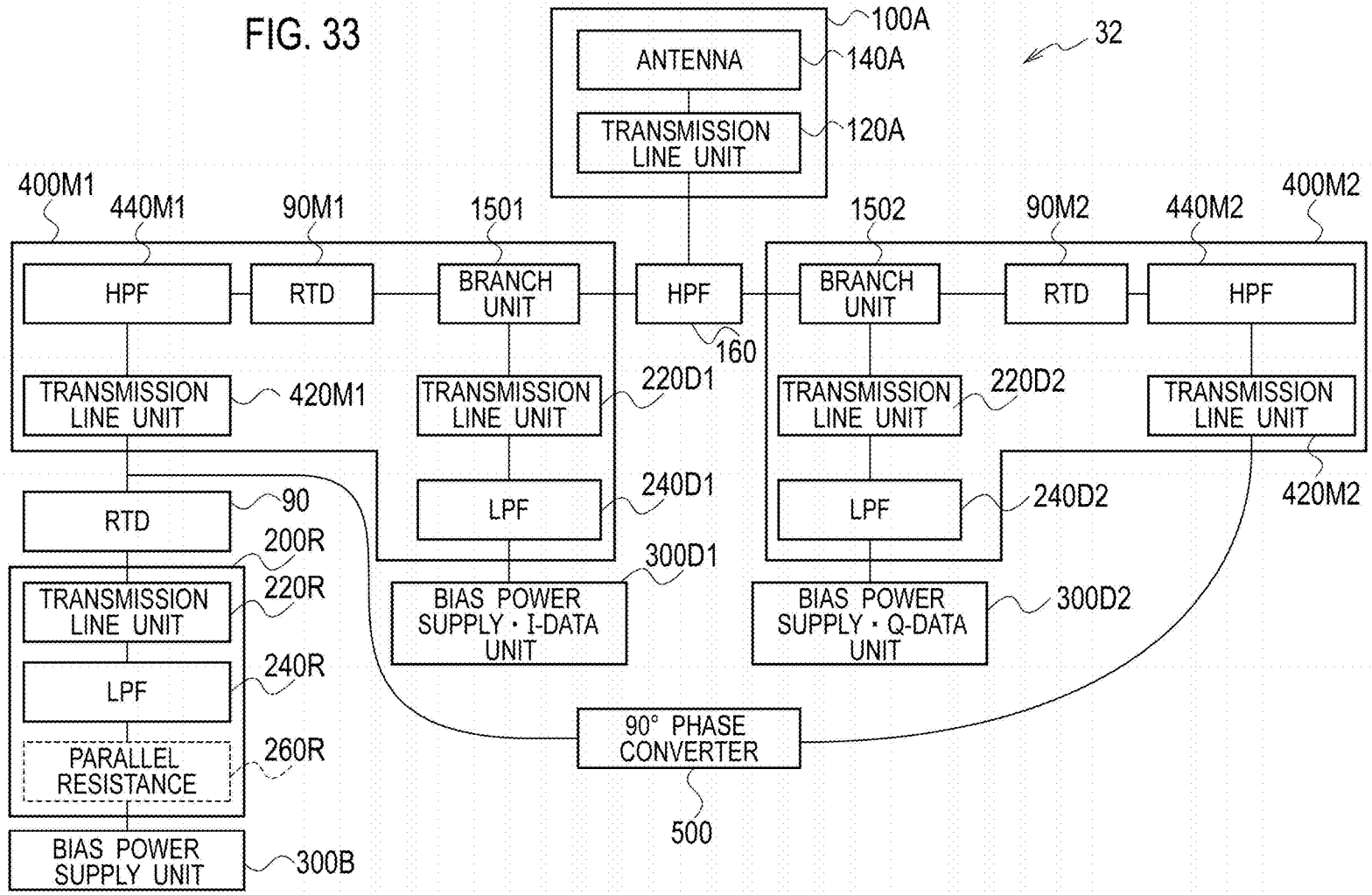
FIG. 33 is a schematic block configuration diagram of an example of realizing an I/Q modulation and demodulation function by arranging the mixer units of an I/Q phase coupled to an oscillator of the I/Q phase, as an application example of structure, in the THz integrated circuit according to the second embodiment.

FIG. 33 is a schematic block configuration of an example of realizing an I/Q modulation and demodulation function by arranging the mixer units of an I/Q phase coupled to an oscillator of the I/Q phase, as an application example 3 of structure, in the THz integrated circuit 32 according to the second embodiment.

As shown in FIG. 33, the THz integrated circuit 32 according to the second embodiment may include: an antenna unit 100A including an antenna 140A capable of transmitting and receiving a THz wave to free space, and a first transmission line 120A connected to the antenna 140A; a first mixer unit 400M1 and a second mixer unit 400M2 connected to the antenna unit 100A; a first active element 90 capable of transmitting and receiving the THz wave, the first active element 90 connected to the first transmission line 120A via the first mixer unit 400M1; a 90° phase converter 500 disposed between the second mixer unit 400M2 and the first active device 90; and resonator unit 200R including a second transmission line 220R for supplying an electric power to the first active element 90, the second transmission line 220R connected to the first active element 90, and a first low-pass filter 240R with respect to the THz wave, the first low-pass filter 240R connected to the second transmission line 220R. In the embodiments, impedance matching of between the antenna 140A and the active element 90 can be realized by an impedance conversion of the first transmission line 120A.

In the embodiments, as shown in FIG. 33, the first mixer unit 400M1 may include: a second active device 90M1 capable of transmitting and receiving the THz wave, the second active device 90M1 connected to the first transmission line 120A; a third transmission line 220D1 for supplying the electric power to the second active device 90M1, the third transmission line 220D1 connected to the second active device 90M1; a second low-pass filter 240D1 with respect to the THz wave, the second low-pass filter 240D1 connected to the third transmission line 220D1; a first high-pass filter 440M1 with respect to the THz wave, the first high-pass filter 440M1 connected to the second active device 90M1; and a fourth transmission line 420M1 connected to the second active device 90M1 via the first high-pass filter 440M1.

Similarly, as shown in FIG. 33, the second mixer unit 400M2 may include: a third active device 90M2 capable of transmitting and receiving the THz wave, the third active device 90M2 connected to the first transmission line 120A; a fifth transmission line 220D2 for supplying the electric power to the third active device 90M2, the fifth transmission line 220D2 connected to the third active device 90M2; a third low-pass filter 240D2 with respect to the THz wave, the third low-pass filter 240D2 connected to the fifth transmission line 220D2; a second high-pass filter 440M2 with respect to the THz wave, the second high-pass filter 440M2 connected to the third active device 90M2; and a sixth transmission line 420M2 connected to the third active device 90M2 via the second high-pass filter 440M2. Moreover, impedance matching of between the antenna 140A and the active elements 90M1, 90M2 can be realized by an impedance conversion of the first transmission line 120A.

Moreover, there may be further provided a bias power supply unit 300B for supplying a bias power to the first active device 90, wherein the bias power supply unit 300B is connected to the resonator unit 200R.

Moreover, there may be further provided a first bias power supply & I-data signal supply unit 300DI for supplying a bias power and I-phase data signals to the second active device 90M1, the first bias power supply & I-data signal supply unit 300DI connected to the first mixer unit 400M1, and a second bias power supply & Q-data signal supply unit 300D2 for supplying a bias power and Q-phase data signals to the third active element 90M2, the second bias power supply & Q-data signal supply unit 300D2 connected to the second mixer unit 400M2.

Moreover, there may be further provided an first branch unit 1501 and a second branch unit 1502, wherein the second active device 90M1 and the third transmission line 220D1 may be connected to the first transmission line 120A via the first branch unit 1501, and a third active element 90M2 and the fifth transmission line 220D2 may be connected to the first transmission line 120A via the second branch unit 1502.

Furthermore, there may be further provided a third high-pass filter 160, and the first mixer unit 400M1 and the second mixer unit 400M2 may be connected to the antenna unit 100A via the third high-pass filter 160.

Figure 34A:
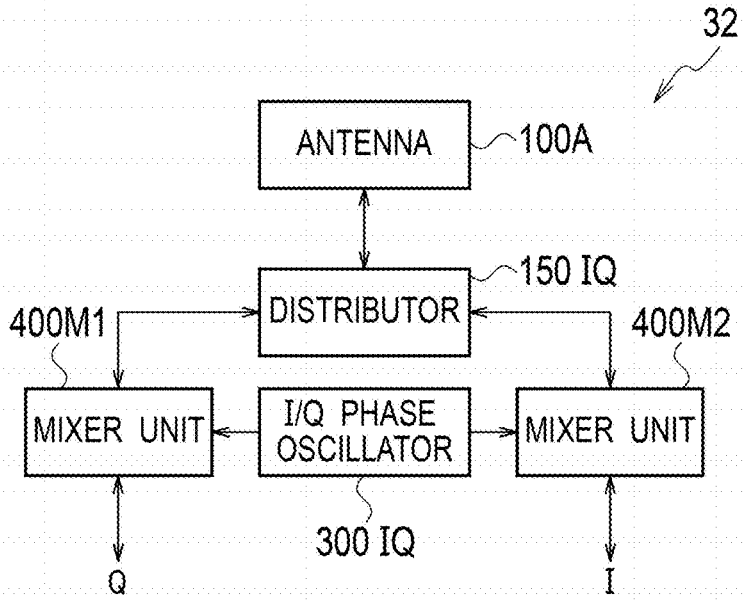
FIG. 34A is a schematic block configuration diagram of simplifying the configuration of FIG. 33.
Figure 34B:
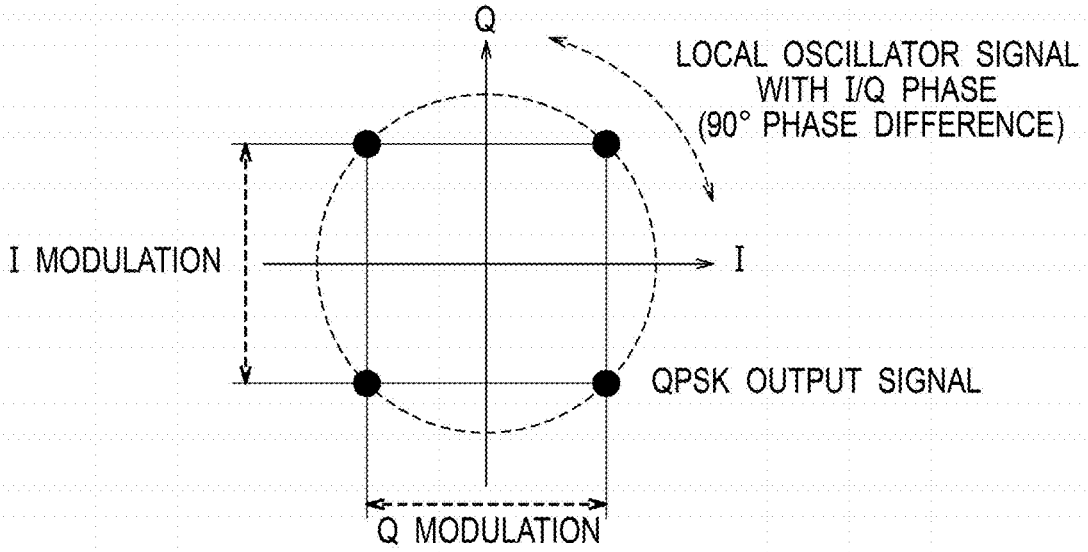
FIG. 34B is an explanatory diagram of the I/Q modulation and demodulation function.

FIG. 34A shows a schematic block configuration of simplified configuration of FIG. 33, and FIG. 34B shows an explanatory diagram of I/Q modulation and demodulation functions in FIG. 34A.

The I/Q phase oscillator 300IQ divides an output of a single local oscillator (resonator unit 200R) into two data, and inputs one data into the 90° phase converter 500 to generate a local oscillating signal of which a phase difference is 90°.

The I/Q modulator and demodulator inputs the signal of the I/Q phase oscillator 300IQ into two mixer units 400M1, 400M2 as each local oscillator signal.

When performing a modulation operation, baseband modulation signals respectively corresponding to I phase and Q phase are input into the respective mixer units 400M1, 400M2.

Since the outputs from the mixer units 400M1, 400M2 become a synthesized signal of an orthogonal signal which has approximately 90° of phase difference on the same frequency, quadrature phase shift keying (QPSK) modulation characteristics having four phases is obtained from the output from the antenna 100A passing through the distributor 150IQ, as shown in FIG. 34B.

When performing a demodulation operation, a signal subjected to QPSK modulation from the antenna 100A with a reversal process is demodulated, and baseband signal outputs corresponding to I phase and Q phase are obtained.

Moreover, if a signal having multiple values is assigned with respect to an amplitude of the baseband input, as multistep, an operation as QAM (quadrature amplitude modulation) can also be realized.

According to the second embodiment, there can be provided the THz integrated circuit of which the transmitting and receiving efficiency in the phase modulation, the synchronous detection, and the modulation/demodulation of the THz signal can be improved by applying the THz device according to the first embodiment and by mixing the THz wave with the data signal of the local oscillator.

According to the embodiments, there can be provided the THz device and the THz integrated circuit, each capable of the high-efficiency matching between the active element and the antenna due to the impedance conversion effect of the transmission line.

Other Embodiments

As explained above, the THz device and the THz integrated circuit according to the embodiments have been described, as a disclosure including associated description and drawings to be construed as illustrative, not restrictive. This disclosure makes clear a variety of alternative embodiment, working examples, and operational techniques for those skilled in the art.

Such being the case, the embodiments described herein cover a variety of embodiments, whether described or not.

INDUSTRIAL APPLICABILITY

The THz device and THz integrated circuit of the embodiments can be applied to THz oscillators, THz detectors, high-frequency resonant circuits, signal amplifiers, etc. on a device basis; and can be applied to wide fields, such as measurement in various fields, e.g., a physical property, an astronomy, a biology, etc. and a security field, other than large-capacity communications and information processing of THz wave imaging devices, sensing devices, high-speed wireless communications devices, etc., on an applicability basis.

What is claimed is:

1. A terahertz device comprising:

an antenna capable of transmitting and receiving a THz wave to free space;

first transmission lines capable of transmitting the THz wave, the first transmission lines connected to the antenna;

an active element of which a main electrode is connected to each of the first transmission lines;

second transmission lines capable of transmitting the THz wave, the second transmission lines connected to the active element;

pad electrodes respectively connected to the second transmission lines; and a low-pass filter with respect to the THz wave, the low-pass filter connected to the pad electrodes, wherein the first transmission lines and the second transmission lines each include strip-line structures, such that a first strip-line structure of the first transmission lines, a first side of the antenna, a first strip-line structure of the second transmission lines, and a first pad electrode of the pad electrodes are located on one side of the active element, and a second strip-line structure of the first transmission lines, a second side of the antenna, a second strip-line structure of the second transmission lines, and a second pad electrode of the pad electrodes are located on an opposite side of the active element, and wherein impedance matching between the antenna and the active element is performed by an impedance conversion of the first transmission lines.

2. The terahertz device according to claim 1, wherein the low-pass filter comprises a metal-insulator-metal (MIM) reflector.

3. The terahertz device according to claim 1, further comprising:

a resistance element connected between the pad electrodes.

4. The terahertz device according to claim 3, wherein the resistance element comprises metallic wiring.

5. The terahertz device according to claim 4, wherein the metallic wiring comprises one selected from the group consisting of Bi, Ni, Ti, and Pt.

6. The terahertz device according to claim 3, wherein the resistance element comprises a semiconductor layer, and the resistance element is disposed below the pad electrodes.

7. The terahertz device according to claim 1, wherein the antenna comprises one selected from the group consisting of a bow tie antenna, a dipole antenna, a slot antenna, a patch antenna, a ring antenna, and a Yagi-Uda antenna.

8. The terahertz device according to claim 1, further comprising:

a semiconductor substrate;

a first semiconductor layer disposed on the semiconductor substrate;

a second electrode connected to one side of the main electrode of the active element formed so as to be layered on the first semiconductor layer, the second electrode connected to the first semiconductor layer and disposed on the semiconductor substrate; and a first electrode connected to another side of the main electrode of the active element, the first electrode disposed on the semiconductor substrate so as to be opposite to the second electrode, wherein the first electrode and the second electrode are connected to the first transmission lines.

9. The terahertz device according to claim 1, wherein the active element comprises one selected from the group consisting of a resonant tunneling diode, a TUNNETT diode, an IMPATT diode, a GaAs based field-effect transistor, a GaN based FET, a high electron mobility transistor, a heterojunction bipolar transistor, and CMOSFET.

10. A terahertz device comprising:

an antenna unit comprising an antenna capable of transmitting and receiving a THz wave to free space, and a first transmission line connected to the antenna;

an active element capable of transmitting and receiving the THz wave, the active element connected to the first transmission line; and a resonator unit comprising a second transmission line for supplying an electric power to the active element, the second transmission line connected to the active element, and a low-pass filter with respect to the THz wave, the low-pass filter connected to the second transmission line, wherein the first transmission line and the second transmission line respectively include strip-line structures, wherein the first transmission lines and the second transmission lines each include strip-line structures, such that a first strip-line structure of the first transmission line, a first side of the antenna, a first strip-line structure of the second transmission line, and a first side of the resonator unit are located on one side of the active element, and a second strip-line structure of the first transmission line, a second side of the antenna, a second strip-line structure of the second transmission line, and a second side of the resonator unit are located on an opposite side of the active element, and wherein impedance matching between the antenna and the active element is performed by an impedance conversion of the first transmission line.

11. The terahertz device according to claim 10, further comprising:

a bias power supply and data signal supply unit for supplying a bias power and a data signal to the active element, the bias power supply and data signal supply unit connected to the resonator unit.

12. The terahertz device according to claim 10, further comprising:

a branch unit, wherein the active element includes a plurality of the active elements and the resonator unit includes a plurality of the resonator units, and the plurality of the active elements and the plurality of the resonator units are connected to the antenna unit via the branch unit.

13. A terahertz integrated circuit comprising a terahertz device, the terahertz device comprising:

an antenna capable of transmitting and receiving a THz wave to free space;

first transmission lines capable of transmitting the THz wave, the first transmission lines connected to the antenna;

an active element of which a main electrode is connected to each of the first transmission lines;

second transmission lines capable of transmitting the THz wave, the second transmission lines connected to the active element;

pad electrodes respectively connected to the second transmission lines; and a low-pass filter with respect to the THz wave, the low-pass filter connected to the pad electrodes, wherein the first transmission lines and the second transmission lines respectively include strip-line structures, wherein the first transmission lines and the second transmission lines each include strip-line structures, such that a first strip-line structure of the first transmission lines, a first side of the antenna, a first strip-line structure of the second transmission lines, and a first pad electrode of the pad electrodes are located on one side of the active element, and a second strip-line structure of the first transmission lines, a second side of the antenna, a second strip-line structure of the second transmission lines, and a second pad electrode of the pad electrodes are located on an opposite side of the active element, and wherein impedance matching between the antenna and the active element is performed by an impedance conversion of the first transmission lines.

* * * * *